US006643454B1

(12) United States Patent
Rochelle

(10) Patent No.: US 6,643,454 B1
(45) Date of Patent: Nov. 4, 2003

(54) BATH TEMPERATURE MAINTENANCE HEATER

(75) Inventor: Gary P. Rochelle, Marina del Rey, CA (US)

(73) Assignee: Alpha-Western Corporation, Gardena, CA (US)

( * ) Notice: Subject to any disclaimer, the term of this patent is extended or adjusted under 35 U.S.C. 154(b) by 0 days.

(21) Appl. No.: 10/262,565

(22) Filed: Oct. 1, 2002

Related U.S. Application Data

(63) Continuation-in-part of application No. 09/813,512, filed on Mar. 20, 2001.

(51) Int. Cl.[7] ..... F24H 1/10
(52) U.S. Cl. ..... 392/485; 392/453; 392/465
(58) Field of Search ..... 392/485–488, 392/465, 466, 449, 451, 453, 398

(56) References Cited

U.S. PATENT DOCUMENTS

| | | | | |
|---|---|---|---|---|
| 1,140,864 A | | 5/1915 | Aubery | |
| 2,266,216 A | | 12/1941 | Kimberlin | |
| 3,749,864 A | * | 7/1973 | Tice | 200/81.9 M |
| 3,952,182 A | | 4/1976 | Flanders | |
| 4,074,097 A | * | 2/1978 | Hutchinson et al. | 200/81.9 R |
| 4,185,187 A | * | 1/1980 | Rogers | 392/489 |
| 4,208,570 A | | 6/1980 | Rynard | |
| 4,556,168 A | | 12/1985 | Romanow et al. | |
| 4,725,714 A | | 2/1988 | Naya et al. | |
| 4,855,569 A | * | 8/1989 | Wiedemann | 392/471 |
| 4,859,345 A | | 8/1989 | Inagaki | |
| 4,924,069 A | * | 5/1990 | Giordani | 392/485 |
| 4,947,025 A | | 8/1990 | Alston et al. | |
| 5,183,983 A | * | 2/1993 | Knop | 200/81.9 M |
| 5,408,578 A | | 4/1995 | Bolivar | |
| 5,479,558 A | * | 12/1995 | White et al. | 392/485 |
| 5,892,888 A | * | 4/1999 | Romero | 392/501 |
| 6,080,971 A | | 6/2000 | Seitz et al. | |

FOREIGN PATENT DOCUMENTS

| | | |
|---|---|---|
| JP | 53-148752 | 5/1977 |
| JP | 59-71946 | 4/1984 |
| JP | 279386 | 9/1990 |

* cited by examiner

*Primary Examiner*—Thor Campbell
(74) *Attorney, Agent, or Firm*—Christensen O'Connor Johnson Kindness PLLC

(57) ABSTRACT

A temperature maintenance heater assembly for maintaining the temperature of a heated fluid circulating through piping of a bath, including a pipe section, a base plate, a control assembly, a heater assembly cover, and a heating element. The heater element is mounted within the pipe section. The control device assembly is electrically connected to the heater element and to a source of power. The control assembly includes a flow switch operable to interrupt the supply of power to the heater element under certain operating conditions, such as when the fluid flow through the pipe section is less than a pre-selected threshold value. By interrupting the supply of power to the heating element under certain operating conditions, the temperature maintenance heater assembly provides operational safety measures to the user.

40 Claims, 21 Drawing Sheets

BATH TEMPERATURE MAINTENANCE HEATER

CROSS-REFERENCE TO RELATED APPLICATIONS

This application in a continuation-in part of U.S. application Ser. No. 09/813,512, filed on Mar. 20, 2001, which is hereby incorporated by reference.

FIELD OF THE INVENTION

The present invention relates to heaters for maintaining the temperature of a personal jetted bath, and particularly to an assembly of a heating control unit and a bath temperature maintenance heater element.

BACKGROUND OF THE INVENTION

Many consumers have installed jetted bathtubs in their residences for relaxation. Hotels often also provide their guestrooms with jetted tubs, and likewise the same may be provided by therapeutic facilities. Jetted baths are typically filled with hot water from a tap. The hot water is drawn from the tub, passed through a pump, and reintroduced into the tub through jets to provide a soaking user with therapeutic and invigorating jets of water. As the tub is used during a soaking session, the temperature of the water in the tub gradually cools due to heat loss through the tub wall and to the ambient air. To avoid this cooling, some jetted tubs may be provided with a heater installed in the water circulation system. The heater is used to maintain the bath temperature at near its original temperature.

Early jetted bathtub heaters evolved from spa heaters. A spa heater must not only maintain the temperature of the large water volume contained in the spa, but also must initially raise the temperature of the water from ambient to the desired elevated temperature. Spa heaters having heating capacities of 1500 watts to 3000 watts have been used to maintain the temperature of much smaller jetted tubs, even though those outputs were excessive in relationship to the reason for providing a bathtub heater in the first place, i.e.: to maintain the water temperature of the bathtub to the bathers individual comfort level. A secondary heat source (other than the domestic hot water tank) is required only to rectify the loss of heat due to the cooling of the bath water below the bather's comfort level. Such cooling may be caused by the induction of air into the bath water, or the cooling effect of the bath water over time, or the inability to add additional water to the bath water from a domestic hot water tank that had been exhausted in the initial filling of the tub. While bath heaters must have an output sufficient to maintain the bath temperature during use for these reasons, such heaters need not initially heat the bath water from ambient, and thus have much lower actual power requirements than for a heater used in a spa.

Conventional bath maintenance heaters are larger in heat capacity than strictly needed to maintain bath temperature, as noted above. Therefore, conventional heaters must be regulated to assure they do not heat the bath water to above a safe upper limit. In designing a bath heater, there is also a need to limit the function of such conventional high-output heating devices when abnormal conditions are encountered that would produce an unsafe condition, due to excessively heating the water. The anticipated unsafe conditions include, (based upon the heaters ability to produce unsafe heating levels): dry fire, low flow, restricted flow, interrupted power (allowing for residual heat build-up in the heater vessel), and temperature-regulating control failure. Therefore, a temperature-regulating controller and high level limiting device have been required to avoid a heater operating in an unsafe condition, such as those noted above.

SUMMARY OF THE INVENTION

The present invention provides a temperature maintenance heater assembly that maintains temperature within a control range by selecting a heater element with a maximum power rating such that it is not capable of heating the water to a point where the water temperature at the outlet exceeds a specified temperature when running continuously. Further, temperature control is also maintained by a flow switch, which will shut off the heater element when low flow or no flow of fluid is present in the piping.

In accordance with aspects of the present invention, a temperature maintenance heater assembly for maintaining the temperature of a previously heated fluid circulating through piping of a bath is provided. The heater assembly includes a heating element having first and second electrical contacts, and a predetermined maximum power rating. The predetermined maximum power rating of the heating element is selected such that the temperature maintenance heater assembly maintains the fluid immediately upstream of the heating element within a specified safe temperature range with the heating element operating continuously at its maximum power rating. The heater assembly also includes a flow switch having an open state and a closed state. The flow switch is electrically connectable to a power supply and at least one electrical contact of the heating element for supplying electricity therebetween. The flow switch acts to interrupt the supply of electricity to the heating element when a threshold value of fluid flow through the piping is not met, the control assembly continuing the supply of electricity to the heating element whenever the threshold value of fluid flow is met. The heater assembly is absent of a control device that controls the electricity supplied to the heating element based on the temperature of the heated fluid.

In accordance with another aspect of the present invention, a heater assembly for heating fluid circulating through piping of a bath is provided. The heater assembly includes a pipe section having an outer wall, an inlet, and at least one outlet, wherein the fluid is circulated through the pipe section between the inlet and the outlet. The heater assembly also includes a mounting structure attached to the outer wall of the pipe section. The mounting structure has an upper surface and a lower surface. The heater assembly further includes a flow switch mounted to the mounting structure and including a pivoting actuator. A portion of the pivoting actuator partially extends into the interior of the pipe section. A heating element is also included in the heater assembly. The heating element has first and second electrical contacts, and is partially housed within the pipe section between the inlet and the outlet. At least one of the electrical contacts is conductively connected to the flow switch. The flow switch is operable to interrupt the supply of electricity to the heating element when a threshold limit of fluid flow through the pipe section is not met, and to continue the supply of electricity to the heating element whenever the threshold limit of fluid flow is met.

In accordance with still yet another aspect of the present invention, a temperature maintenance heater assembly of a hydro-massage bath having a fluid capacity and operable for maintaining the temperature of a heated fluid circulating through piping of the bath is provided. The heater assembly includes a pipe section with an outer wall, an inlet, and at least one outlet. A heating element is included that is housed partially in the pipe section. The heating element has a first and second electrical contacts and a maximum power rating, wherein the maximum power rating of the heating element is selected based on the fluid capacity of the bath. The heater assembly further includes a control assembly coupled to the pipe section. The control assembly includes a flow switch. The flow switch includes first and second electrical terminals and a switch actuator pivotally movable from an at-rest position, wherein the flow switch is in an open position, to at least one different position remote from the at-rest position, wherein the flow switch is in a closed position. The control assembly is conductively connected to at least one of the electrical contacts of the heating element.

In accordance with still another aspect of the present invention, a pipe section for a heater assembly of a bath is provided. The pipe section includes a center pipe segment sized and configured to accept a heating element therein, and a pipe branch selectively coupled in fluid communication to the center pipe segment. The pipe branch extends transverse from the center pipe segment when coupled thereto and includes an end flange.

In accordance with yet another aspect of the present invention, a method of maintaining the temperature of a heated fluid circulating through a hydro-massage bath having associated piping is provided. The method begins by circulating the heated fluid through a pipe segment of the associated piping by a pump. The pipe segment includes an inlet, at least one outlet, and a heating element housed partially within the pipe section. The pump is adapted to be connected in fluid communication to at least one exit port of the bath. The heat from the heat element is then transferred to the heated fluid circulating through the pipe segment. The heating element receives power from a power source and has a pre-determined maximum power rating. The predetermined maximum power rating of the heating element is selected such that the fluid in the bath is maintained within a specified safe temperature range with the heating element operating continuously at its maximum power rating. The power is supplied continuously to the heating element so that the heating element operates at its maximum power rating absent abnormal operating conditions.

The present invention thus provides a low wattage temperature maintenance heater assembly that, by virtue of its limited maximum power rating heating element, is able to overcome the heat loss present during bathing. As low-flow and dry-fire conditions may be protected by the flow switch, the temperature maintenance heater assembly is called upon to also protect the heater element and bather should restricted flow (blockage or minimal flow insufficient to allow for normal operating temperatures to be maintained) be encountered, or for failure to control the temperature within normal operating parameters. The present invention may be practiced in the absence of a temperature-regulating device; instead the control assembly is used in conjunction with the limited maximum power rating heating element solely to respond to unsafe conditions which are flow related.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DESCRIPTION OF THE PREFERRED EMBODIMENT

Figure 1A:
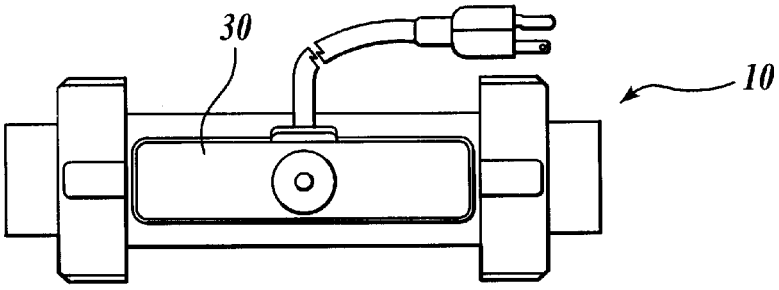
FIGS. 1A, 1B and 1C are top, side and end elevation views, respectively, of a temperature maintenance heater assembly constructed in accordance with the present invention.
Figure 1B:
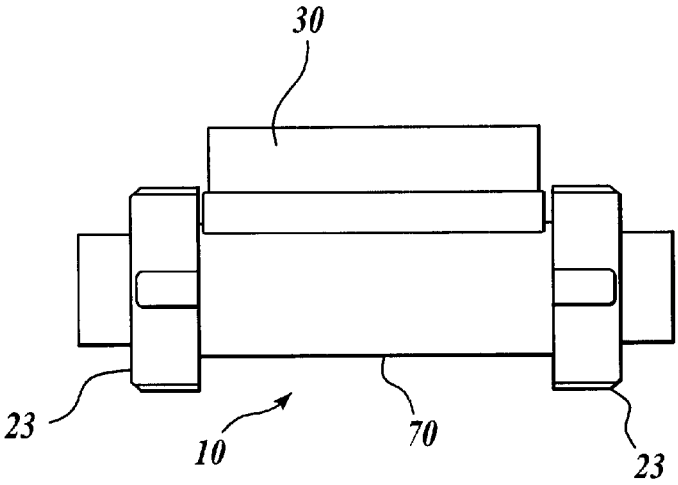
Figure 1C:
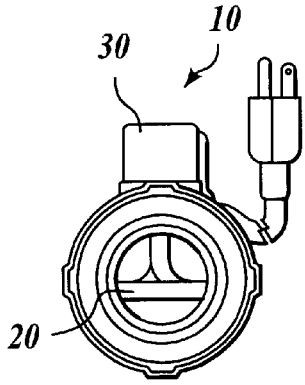

The present invention will now be described where like numbers represent like elements. A bath temperature heater assembly 10 constructed in accordance with an embodiment the present invention is shown in FIGS. 1A, 1B and 1C. The assembly 10 includes a heating element 20 housed within a pipe section 70 that is provided with first and second end fittings 23 to enable installation of the assembly 10 in a fluid flow pipe circuit of a jetted bath. It will be understood that as used herein, the term-jetted bath includes bathtubs, spas, hot tubs, or other personal soaking devices. The heater assembly 10 further includes a control assembly 30 that controls the supply of power to the heating element 20. The control assembly 30 is mounted on the exterior of the pipe section 70.

Figure 1D:
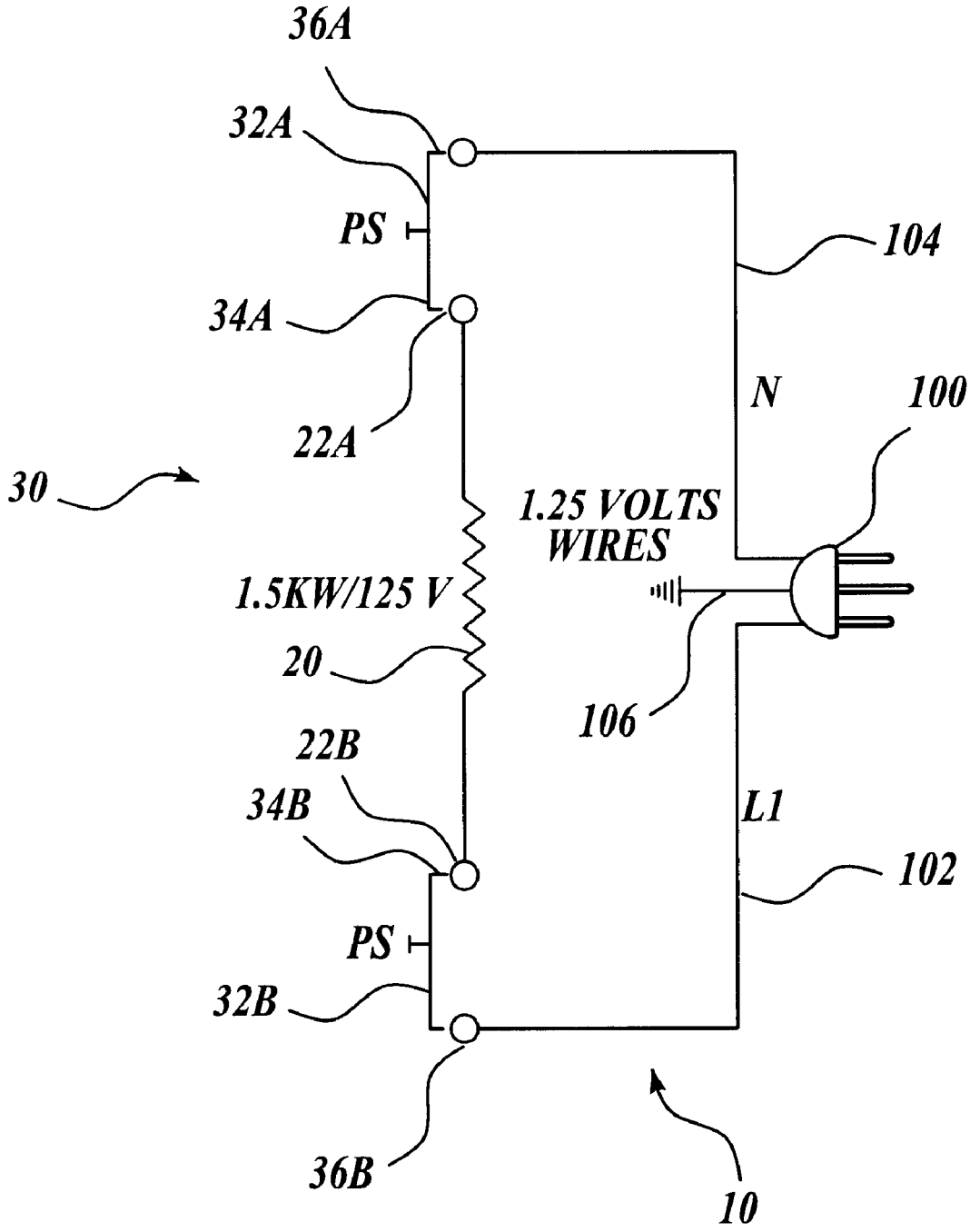
FIG. 1D is a circuit diagram of an embodiment of the electrical components of the temperature maintenance heater assembly of FIG. 1A.

Referring now to FIG 1D, a circuit diagram of a first embodiment of a temperature maintenance heater assembly 10 of the present invention is shown. The heater assembly 10 includes the heating element 20 and the control assembly 30. The control assembly 30 includes first and second pressure switches 32A and 32B. Each pressure switch 32A and 32B includes first and second electrical terminals 34A and 36A, and 34B and 36B respectively. The circuit diagram here shows the pressure switches 32 in parallel arrangement; it will be understood however that the switches 32A and 32B may alternatively be configured in series. The heating element 20 includes first and second electrical contacts 22A and 22B. The first switch 32A is connected to the heating element 10 first electrical contact 22A by the first electrical terminal 34A. Likewise the second switch 32B is connected to the heating element 20 second electrical contact 22B by the first electrical terminal 34B. The first switch 32A is connected to the neutral lead 104 by the second electrical terminal 36A and the second switch 32B is connected to the hot lead 102 by the second electrical terminal 36B. It will be understood that the neutral lead 104 could alternatively be connected the second switch 32B, and the hot lead 102 connected to the first switch 32A. Thus, the pressure switches 32 act to interrupt the supply of electricity from a power supply via the power cord 100 to the heating element 20.

The circuit shown in FIG 1D is physically embodied in a control assembly 30 that includes the two switches 32A and 32B which may be mounted on base plate 40 for attachment to the pipe section 70. Diaphragm assemblies enable the switches and 32B to sense pressure inside the pipe section 70. A cover for the base plate enables the control assembly 30 to be sealed from water leakage and user tampering. A power cord 100 may be sealed between the base plate and the cover and attached electrically to the control assembly to provide power to the heating element 10. The heating element 10 has first and second electrical contacts 22A and 22B that extend through apertures in the pipe section, passing through the base plate to be connected to the switches 32A and 32B. The pipe section 70 includes lugs that passing through the base plate to secure the base plate to the pipe section. Each of these components will now be described in turn.

Figure 2:
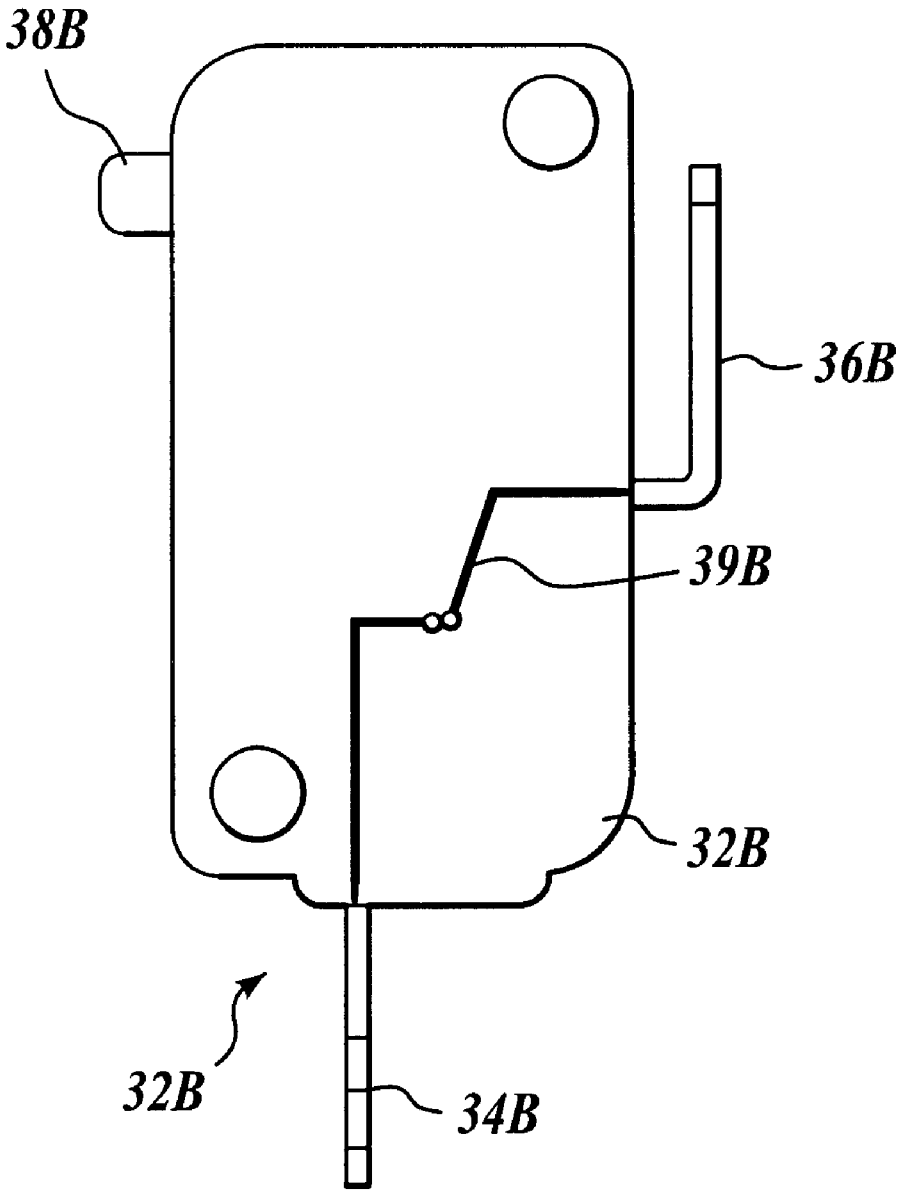
FIG. 2 is a side view of a normally closed pressure switch suitable for use in the circuit of FIG. 1D.

Referring now to FIG. 2, a side view of a normally closed second pressure switch 32B is shown. The second switch 32B includes first and second electrical terminals 34B and 36B, pressure sensor 38B, and switch mechanism 39B activated by the pressure sensor 38B. As illustrated, the switch mechanism 39B may suitably be normally closed.

Figure 3:
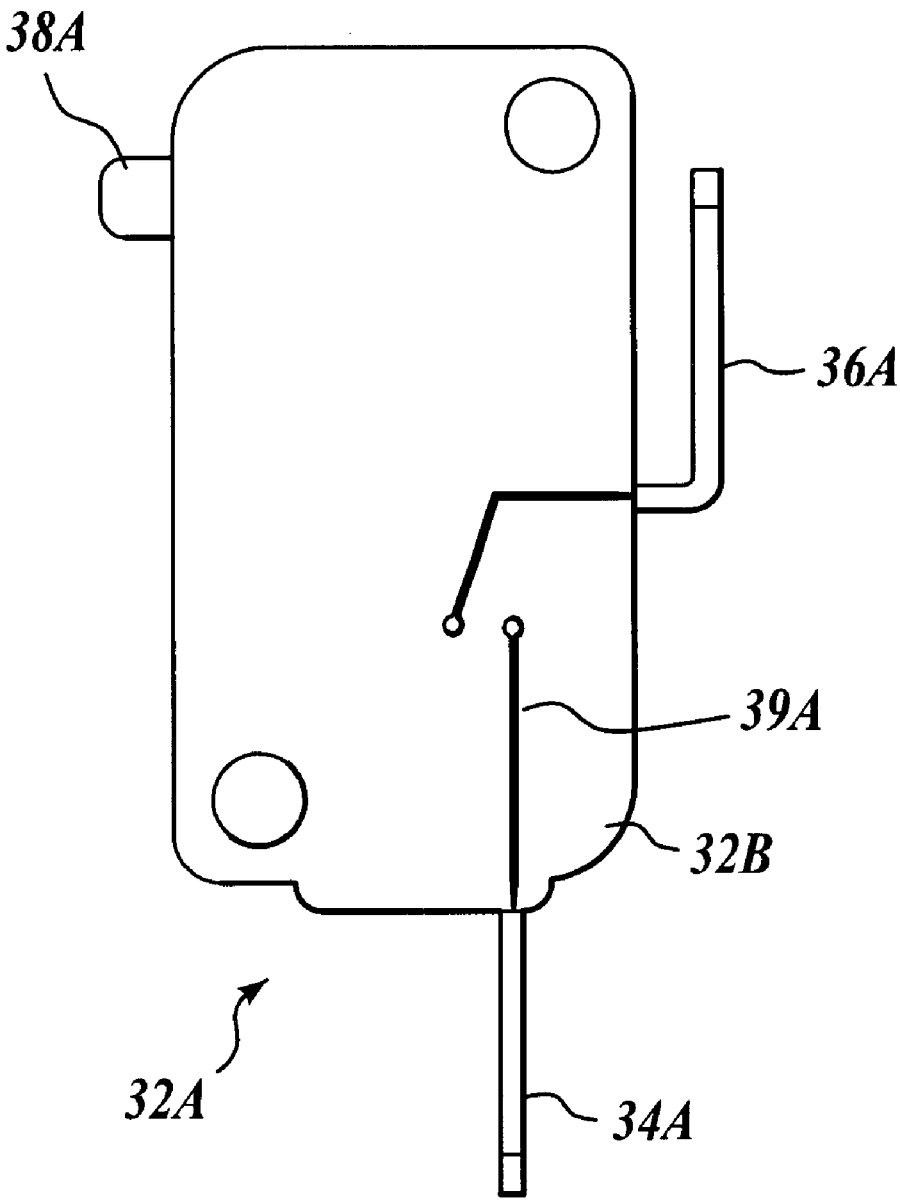
FIG. 3 is a side view of a normally open pressure switch suitable for use in the circuit of FIG 1D.

Referring now to FIG. 3, a side view of a normally open first pressure switch 32A is shown. The first switch 32A includes first and second electrical terminals 34A and 36A, pressure sensor 38A, and switch mechanism 39A activated by the pressure sensor 38A. As illustrated, the switch mechanism 39A may suitably be normally open.

While a normally closed switch 39B and normally open switch 39A are shown other configurations are within the scope of the present invention.

Figure 4:
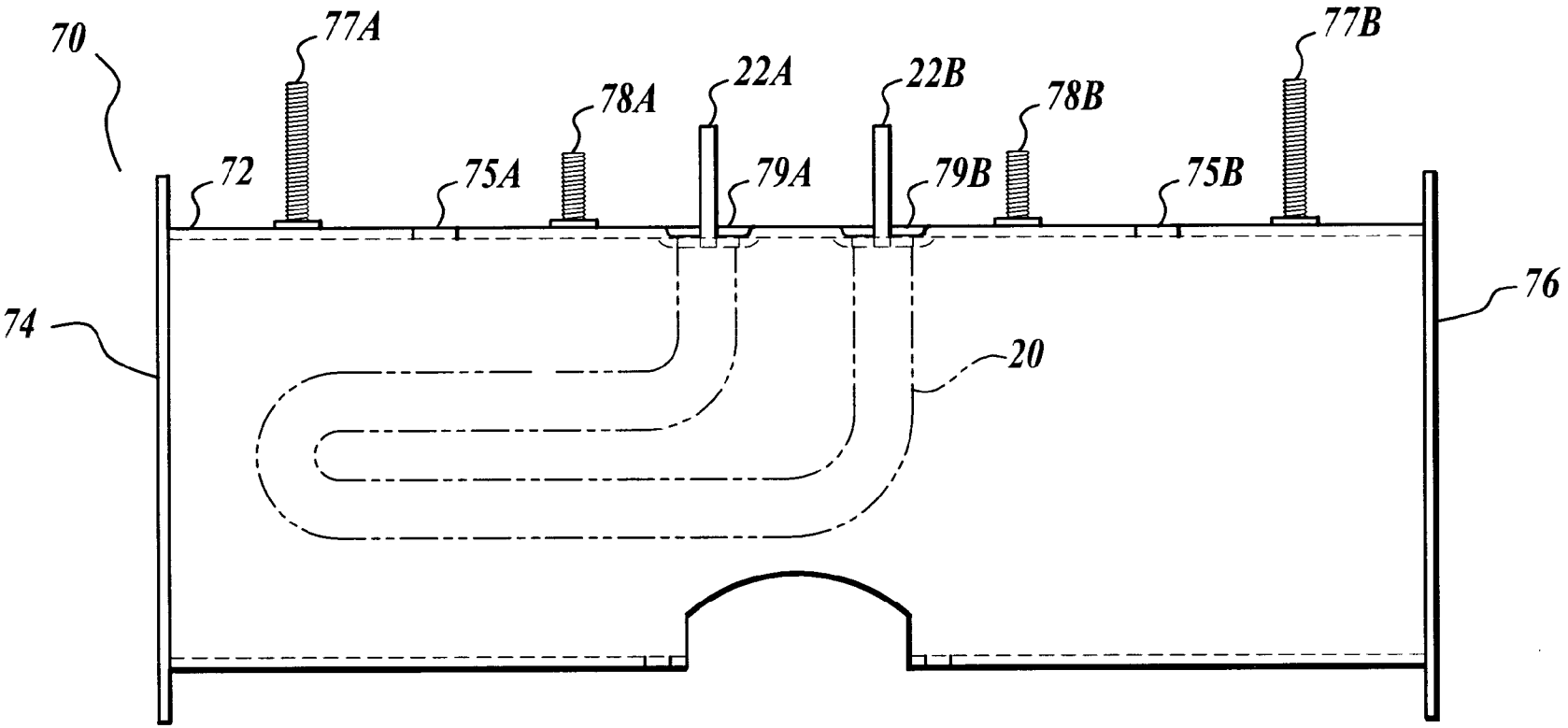
FIG. 4 is a cross-sectional side view of a heating element housed in a pipe section of the assembly of FIG 1A.

Referring now to FIG. 4, a cross-sectional side view of a heating element 20 housed in the pipe section 70 is shown. The temperature maintenance heater assembly 10 may be installed in a pipe section 70. Preferably the pipe section 70 includes an outer wall 72, inlet 74, outlet 76, first and second outer lugs 77A and 77B, first and second inner lugs 78A and 77B, and first and second pipe heater contact apertures 79A and 79B. The lugs 78 and 79 and the apertures 79 are preferably all located along a single bi-sectional line running from the inlet 74 to the outlet 76. Moving from the inlet 74 to the outlet 76 along the bi-sectional line, the first outer lug 77A is located near the inlet 74. Moving from the outlet 76 to the inlet 74 along the bi-sectional line, the second outer lug 77B is located near the outlet 76. The first and second pipe heater contact apertures 79A 79B are located near the center of the pipe segment 70, between the first and second outer lugs 77A and 77B. The first inner lug 78A is located between the first pipe heater contact aperture 79A and the first outer lug 77A. The second inner lug 78B is located between the second pipe heater contact aperture 79B and the second outer lug 77B. The first pipe pressure sensor aperture 75A is located between the first outer lug 77A and the first inner lug 78A. Likewise, the second pipe pressure sensor aperture 75B is located between the second outer lug 77B and the second inner lug 78B.

Figure 5A:
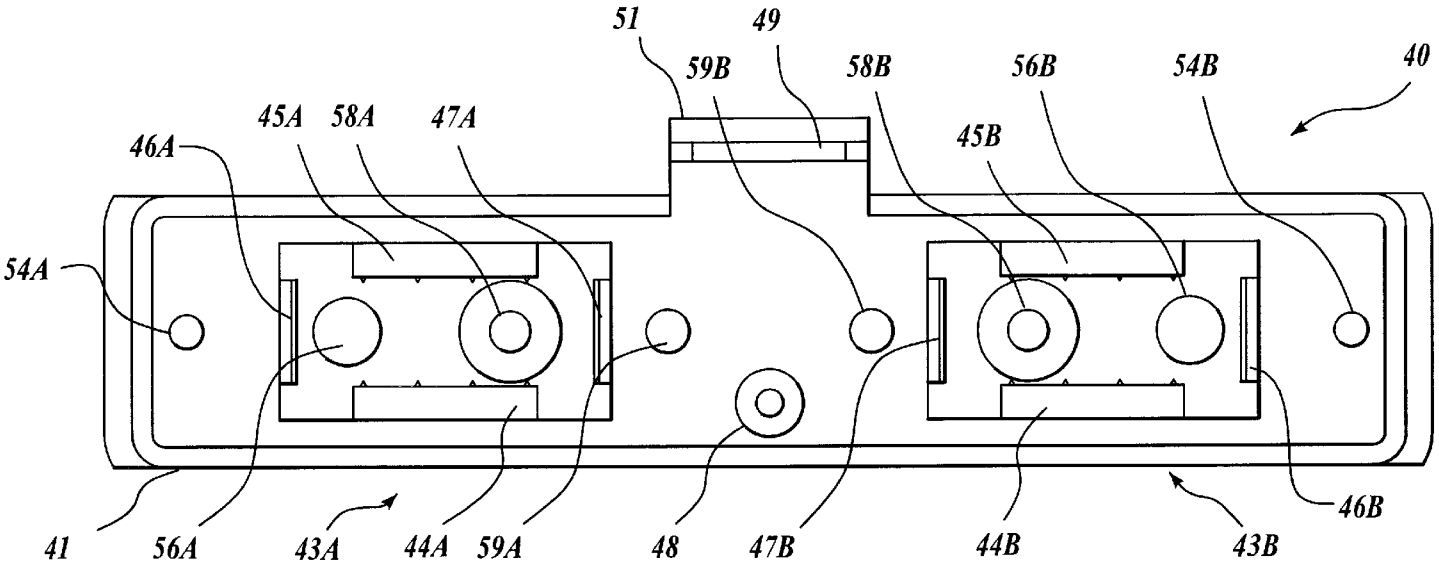
FIGS. 5A and 5B are top and side perspective views of a base plate of the assembly of FIG 1A.
Figure 5B:
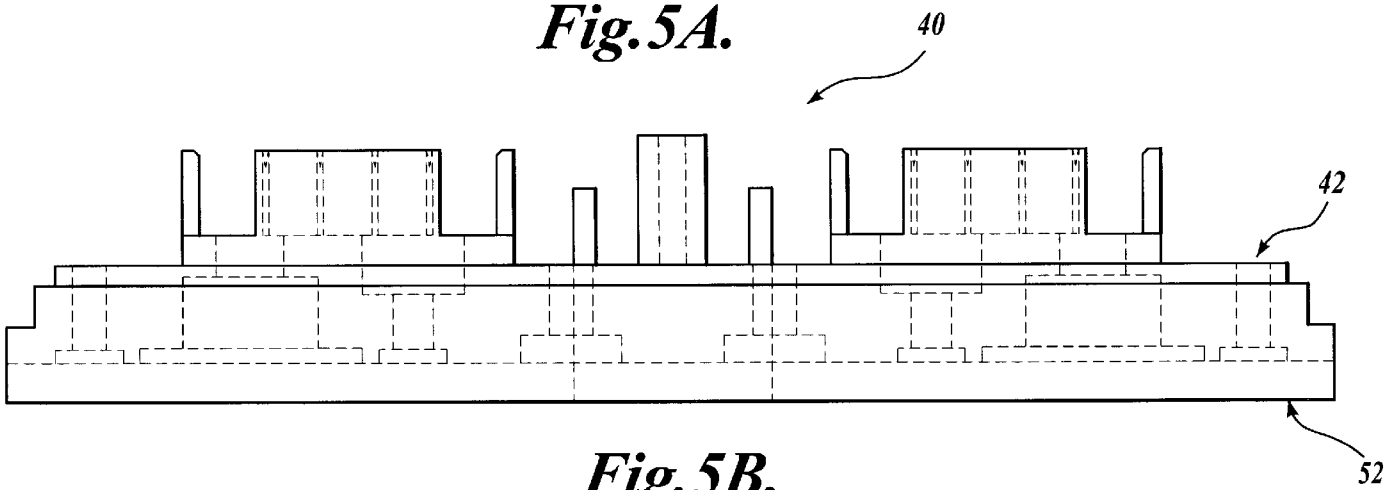

Referring now to FIG. 5A, a perspective view of a base plate 40 is shown. The base plate 40 is used to mount the switches 32A and 32B onto the pipe section 70, and provides for electrical connection between the first and second electrical contacts 22A and 22B of the heating element 30 and the switches. Base plate 40 is generally rectangular in configuration, and includes an upper surface 42, a lower surface 52, a front side 41, and a backside 51. The base plate 40 includes apertures passing from the lower surface 52 to the upper surface 42, including first and second outer lug apertures 54A and 54B, first and second pressure sensor apertures 56A and 56B, first and second inner lug apertures 58A and 58B, and first and second base heater contact apertures 59A and 59B. Working out from the center of the base plate 40 and running along the long dimension of the base plate, the first and second base heater contact apertures 59A and 59B are located towards the center of the base plate 40. The first and second outer lug apertures 54A and 54B are located away from the center and towards the outer edges of the base plate 40. The first inner lug aperture 58A is located between the first outer lug aperture 54A and the first base heater contact aperture 59A. Likewise, the second inner lug aperture 58B is located between the second outer lug aperture 54B and the second base heater contact aperture 59B. The first pressure sensor aperture 56A is located between the first outer lug aperture 54A and the first inner lug aperture 58A. Likewise, the second pressure sensor aperture 56B is located between the second outer lug aperture 54B and the second inner lug aperture 58B.

On the upper surface 42, the base plate includes first and second switch fittings 43A and 43B, a cover fitting 48, and a power cord fitting 49. The first switch fitting 43A may have first and second side pieces 44A and 45A and first and second end pieces 46A and 47A. Likewise, the second switch fitting 43B may have first and second side pieces 44B and 45B and first and second end pieces 46B and 47B. The sidepieces 44 include rough surfaces or small projections that project toward the front side 41 of base plate 40. Likewise, the sidepieces 45 include rough surfaces or small projections that project toward the backside 51 of base plate 40. These rough surfaces may exert a mechanical force against the sides of a switch that is inserted into the fitting 43, to retain the switch in place. In an alternative embodiment, the switch fittings 43 may have holes (not shown) to accept screw, bolts, or other fastening devices to attach the switches to the switch fittings 43.

The cover fitting 48 is located towards the front side 41 and approximately at the center of the base plate 40. The cover fitting 48 is a hollow column with grooves on the inner surface to engage corresponding threading of a cover fastener.

The power cord fitting 49 is located towards the backside 51 and approximately at the center of the base plate 40. The power cord fitting 49 has a general rectangular shape and extends out from the base plate perpendicular to the surface of the backside 51. The power cord fitting 49 has two vertical columns placed at the corners of the power cord fitting 49 that are the farthest from the back side 51. The power cord fitting 49 also has a groove running parallel to the backside 51 of base plate 40 and positioned between the vertical columns and the backside 51.

Figure 6:
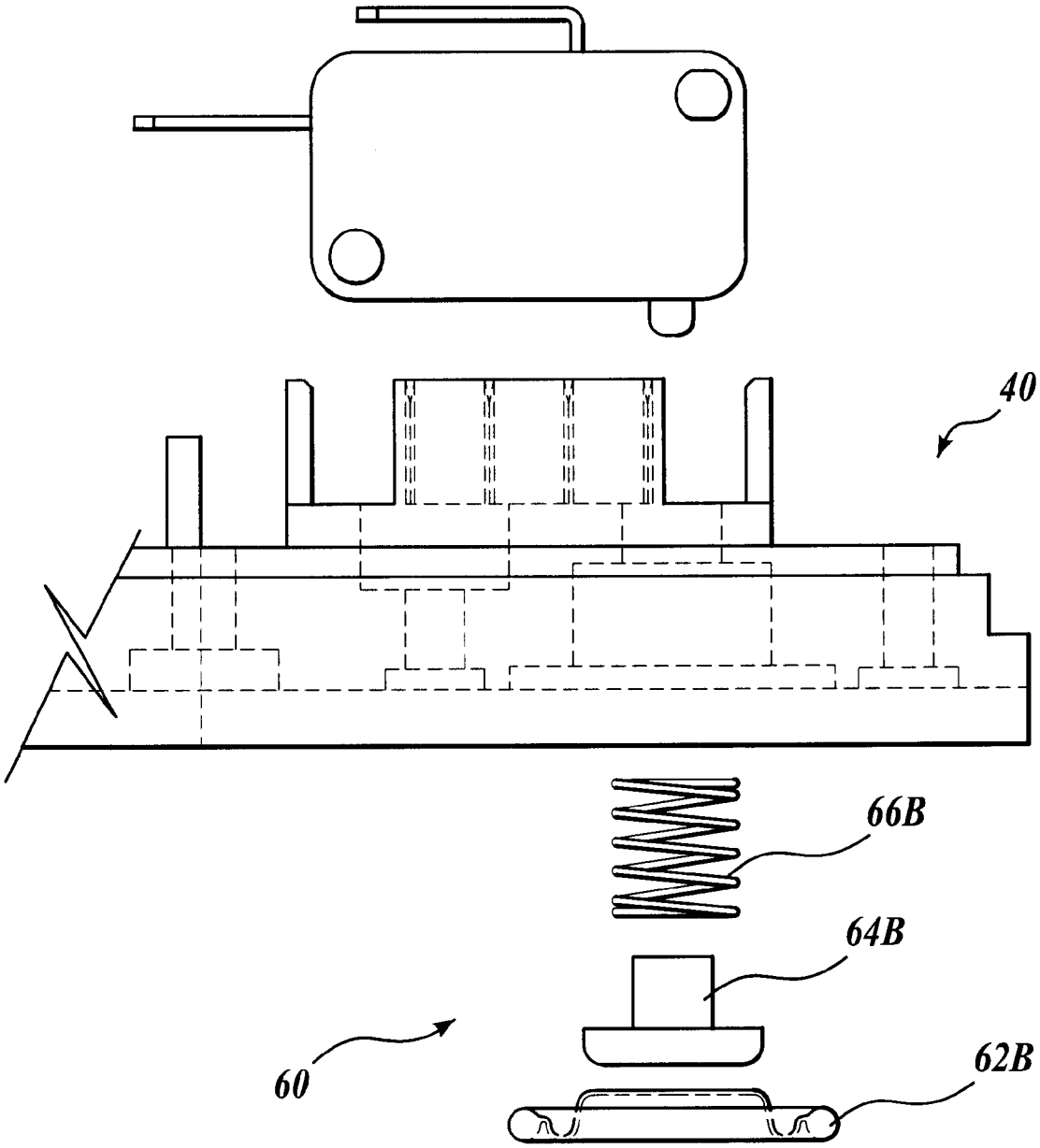
FIG. 6 is an exploded side view of a diaphragm and base plate assembly of the assembly of FIG 1A.

Referring now to FIG. 4, 5A, and 6, an exploded side view of a diaphragm assembly 60 is shown. The diaphragm assembly 60 reacts to positive or negative pressure differentials between ambient pressure and the pressure inside the pipe and acts upon the pressure sensor of the pressure switch in response to this pressure differential. The diaphragm assembly 60 includes first and second diaphragm 62A and 62B, first and second pusher 64A and 64B, and first and second spring 66A and 66B. The base plate 40 may be attached to the outer wall 72 of the pipe section 70. When this is done diaphragm assembly 60 may be placed within the pressure sensor aperture 56 and in fluid flow communication with the pipe pressure sensor aperture 75 of the pipe section 70. The diaphragm 62 is positioned directly on top of the pipe pressure sensor aperture 75. The pusher 64 has a broad base that is positioned directly on top of the diaphragm 62, and a narrower column portion that extends vertically from the broad base. At one end, the spring 66 is positioned directly against the base plate 40 along an inner lip of the pressure sensor aperture 56, and at the other end the spring 66 is positioned about the pusher 64 column portion and against the broad base. The diaphragm 62 flexibly responds to pressure through the pipe pressure sensor aperture 75 and acts upon the pusher 64. The pusher 64 in turn acts upon the spring 66. The spring pushes against the base plate 40. Once switch 32 is inserted into the switch fitting 43, the pressure sensor extends into the pressure sensor aperture 56; the pusher 64 may also act upon the pressure sensor 38 to activate the pressure switch 32.

Figure 7:
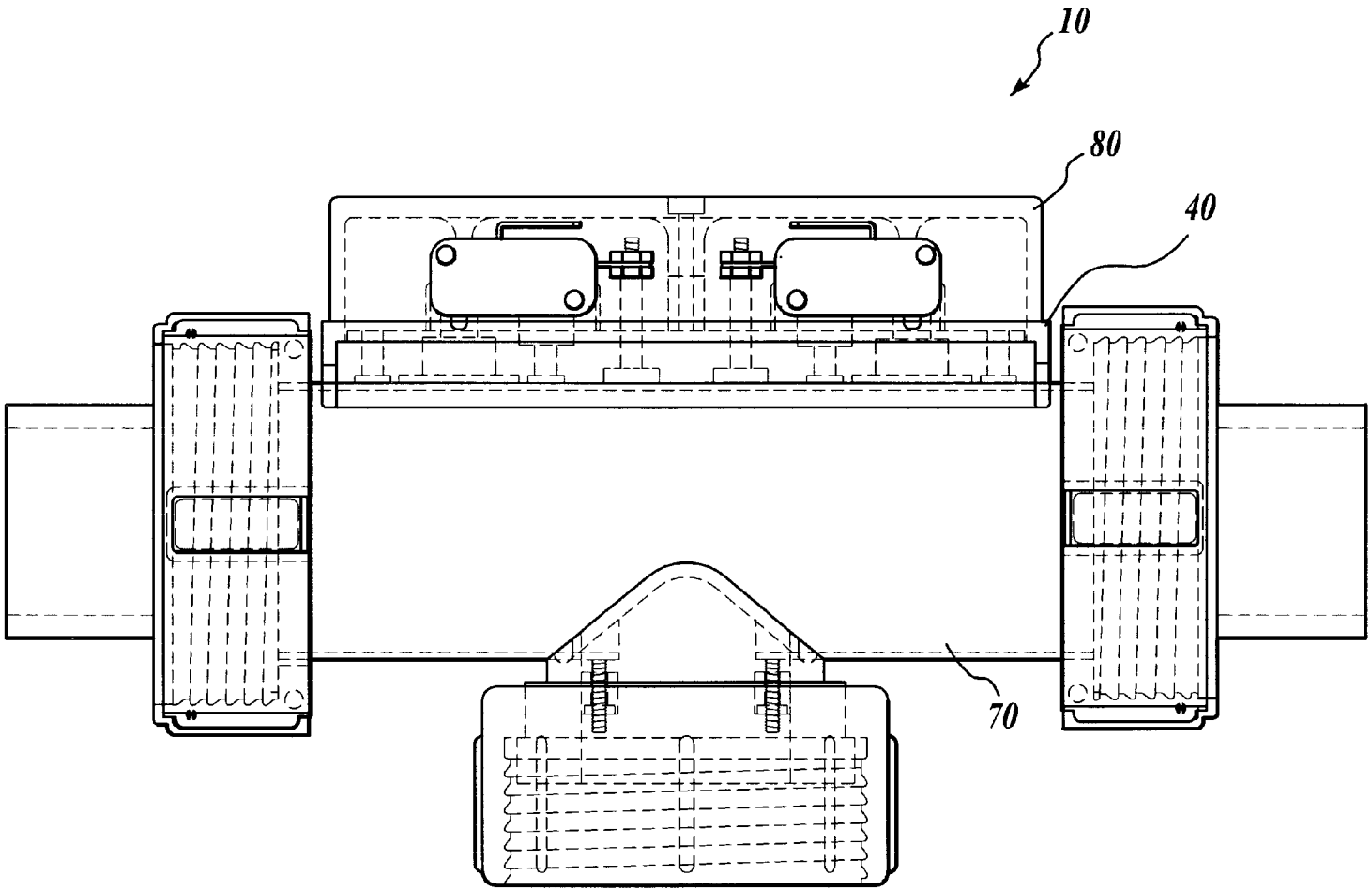
FIG. 7 is a cross-sectional side view of the temperature maintenance heater assembly of FIG 1A.

Referring now to FIG. 7, a cross-sectional side view of the temperature maintenance heater assembly 10 is shown. In this view, the base plate 40 has been attached to the pipe section 70, and the switches 32A and 32B have been attached to the base plate 40 and to the heating element 20. The base plate may be secured to the pipe section 70 by inserting the outer lugs 77A and 77B through corresponding outer lug apertures 54A and 54B, as well as inserting the inner lugs 78A and 78B into corresponding inner lug apertures 58A and 58B, and securing the protruding lug ends against the upper surface 42 of base plate 40. The pipe section 70 and the base plate 40 may be secured together with a waterproof seal.

Additionally, switches 32A and 32B may be retained on the base plate by the switch fittings 43A and 43B. Once inserted into the fittings 43A and 43B, the pressure sensors 38 extend into the corresponding pressure sensor apertures 56.

The heating element 20 electrical contact 22A and 22B may extend through the pipe segment 70 pipe heater contact apertures 79A and 79B, as well as extending though the base plate 40 heater contact apertures 59A and 59B. The portion of the electrical contacts 22 extending past the upper surface 42 of base plate 40 may be contacted electrically with the control assembly 30.

Figure 8C:
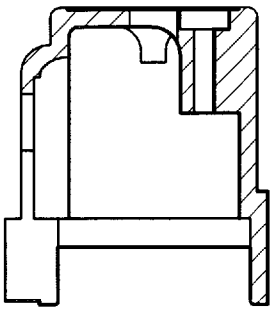
FIGS. 8A, 8B, 8C, and 8D are top, side, and end perspective views of a base plate cover of the assembly of FIG 1A.
Figure 8D:
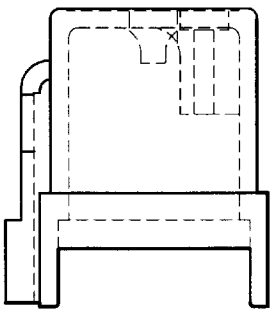
Figure 8A:
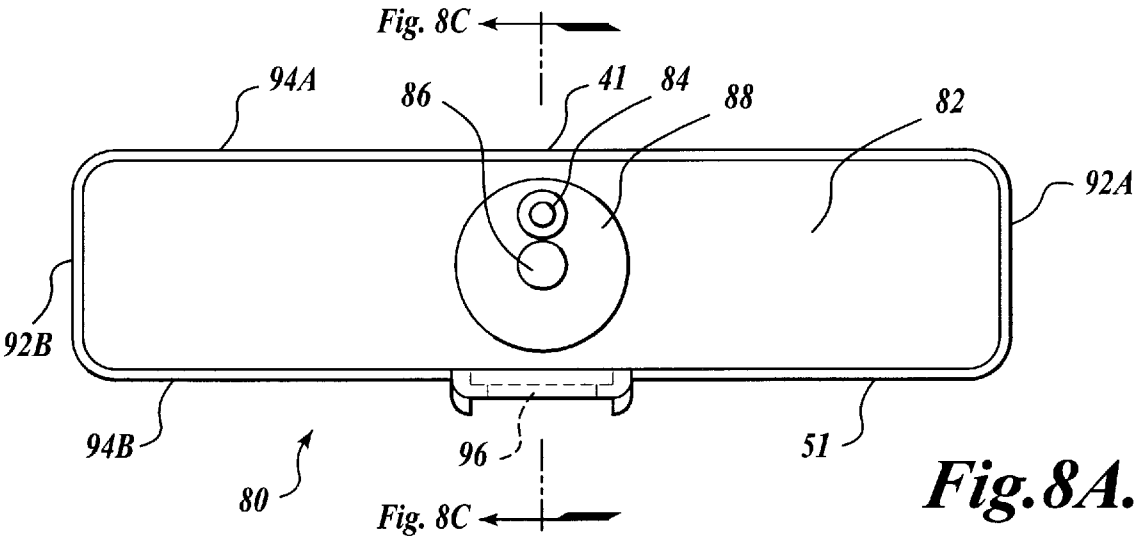
Figure 8B:
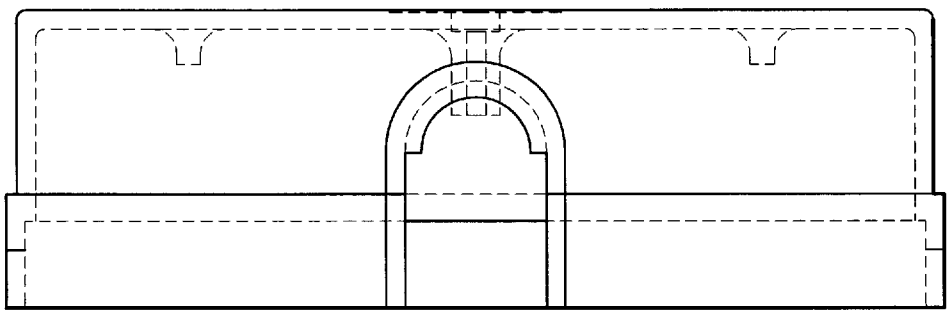

Referring now to FIG. 8A, a perspective view of a base plate cover 80 is shown. The base plate cover 80 includes a top wall 82, first and second end walls 92A and B, and first and second sidewalls 94A and B. The end walls 92 and sidewalls 94 are constructed to removably seal against base plate 40 and enclose the control assembly 30. The seal between the cover 80 and the base plate 40 may be a waterproof seal. The top wall 82 includes a cover fastener assembly 84 to removably secure the cover 80 to the base plate 40. In one embodiment the cover 80 has a fastener aperture into which a screw may be inserted and threaded to the base plate cover fitting 48. A tamperproof seal 88 may be provided for covering the fastener assembly 84*d*, to restrict the ability to remove the cover 80. Additionally, an indication light 86 may be incorporated into the cover to provide a visual indication as to whether the temperature maintenance device 10 is functioning properly. It will be understood that as used herein, the indication light 86 may comprise a light emitting diode (LED), a neon light, or some other light source. The second side wall 94B includes a power cord aperture 96 to accept and retain power cord 100. The power cord aperture 96 corresponds to and accepts the power cord fitting 49, so that when the base plate 40 and cover 80 are joined together about power cord 100, the power cord 100 is retained and partially sealed within the cover 80 and base plate 40.

Figure 9B:
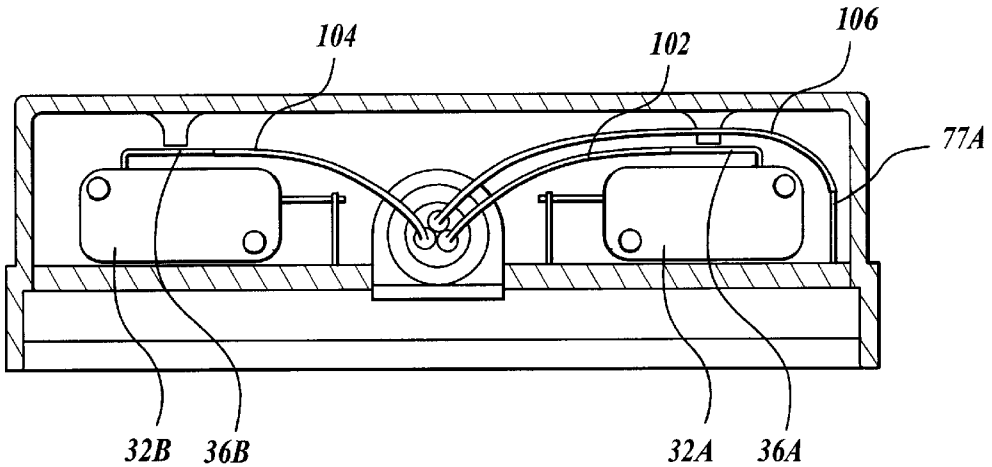
FIGS. 9A and 9B are side and end perspective views of a power cord of the assembly of FIG 1A.
Figure 9A:
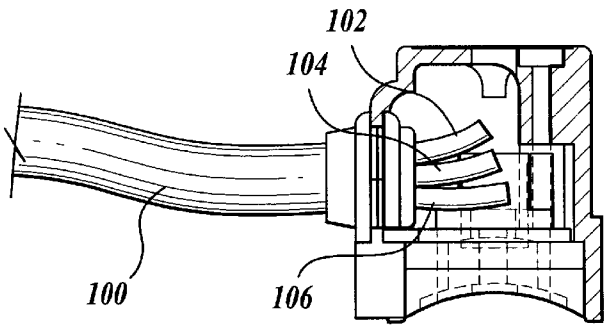

Referring now to FIG. 9A, a perspective view of a power cord 100 is shown. The power cord 100 includes a hot lead 102, a neutral lead 104, and a ground lead 106. The hot and neutral leads 102 and 104 may be connected to the second electrical terminals 36A and 36B to supply power to the control assembly 30. The ground lead 106 may ground the temperature maintenance heater assembly 10 by conductively connecting to one of the lugs attached to the pipe segment 70, preferably outer lugs 77A or 77B. To facilitate grounding, it is preferred that the pipe segment 10 also be conductive.

In a preferred embodiment, the first pressure switch 32A may be actuated by the pressure differential between the atmosphere and the pump pressure inside the heater assembly 10 when the pressure inside the pipe section 70 exceeds a prescribed low pounds per square inch (PSI) rating. Preferably, the first pressure switch 32A is normally open and may be closed when actuated. The second pressure switch may be actuated by the pressure differential between the atmosphere and the pump pressure inside the heater assembly when the pressure inside the pipe section 70 exceeds a prescribed high PSI rating. Preferably, the second pressure switch 32B is normally closed and may be opened when actuated. In one embodiment the first pressure switch will be set to actuate to the closed position at 2 PSI to complete the circuit for normal fluid flow, while the second pressure switch will be set to actuate to the open position at 15 PSI to break the circuit for pressure surges (such as outlet blockage or closure).

The safety issues involving the following abnormal conditions are addressed by the temperature maintenance heater assembly 10: dry-fire protection, temperature-control, temperature-limiting, low water, no water, interrupted power, blocked suction cover (low or no flow abnormal), adjustable jets in off position (low or no flow abnormal), or cavitation of the pump (low or no flow abnormal). Each of these abnormal conditions will be discussed below with indication as to the method of safety control provided by the temperature maintenance heater assembly 10.

The present invention's design incorporates the first pressure switch 32A that senses the loss of flow in the pipe section 70 and opens when the pressure inside the pipe section 70 falls below 2 PSI. This loss of pressure is an indication of loss of flow and is a common method of dry-fire protection. Low water conditions will result in the pump not priming sufficiently to produce a PSI rating above the 2 PSI switch setting, therefore low water abnormal condition is protected within the control assembly 30 containing the first pressure switch 32A. This circuit will not allow the heater element to function until the low water condition is corrected by the manual action of the user.

A no water abnormal condition is protected in the same manner as low water abnormal condition, by the inclusion of the first pressure switch 32A in the control assembly 30. Should a no water condition be encountered, first pressure switch 32A will not close and the heater element 20 cannot be energized, nor will energizing of the heating element take place until the user corrects the no water condition by manual action.

Blocked suction will also result in low water pressure in the heater assembly 10 caused by blockage on the inlet side of the heater assembly 10. This will result in the heater element 20 being shut down by first pressure switch 32A and the heater element 20 will remain off until the user manually corrects the unsafe condition by removing the blockage and restoring the system to normal safe operating status.

If air is introduced into the impeller of the pump in sufficient quantity, it is possible that the air entertainment will result in loss of pressure inside the pipe section 70. This is safeguarded in the present invention's heater assembly 10 by first pressure switch 32A which will open on the loss of pressure and cannot be reset without the user taking a manual action of correcting the source of the cavitation and restoring the system to normal safe operating condition.

The present invention's design incorporates the limited maximum power rating output resistance element 20. It is preferred that the heating element 20 has a predetermined wattage selected to maintain bath temperature. For example, the heating element 20 may be a maintenance heater of 700 watts or less (to be determined upon testing). This element is capable of maintaining the water temperature of a specified bath within the maximum allowable operating temperatures, thus providing temperature-control without the need for a temperature-regulating thermostat.

The present invention's approach to providing a temperature-limiting control is in providing the required control assembly 30 in conjunction with the heater element 20 with a limited maximum power rating. The first pressure switch 32A is normally open and contributes to the temperature-limiting control by sensing a loss in pressure that would be associated with any abnormal condition in the system that would limit or reduce the flow of water through the heater assembly 10, which would be the result of an unsafe condition. This is accomplished when the first switch 32A senses operating pressures below the 2 PSI set-point (or other predetermined minimum flow threshold), and remains open. The first switch 32A cannot be automatically reset without the user first manually correcting the unsafe condition that caused the switch to open and interrupt the power to the heating element. The switch can only be reset by the users manual action, regardless of any other of the circuits' components opening or closing.

The present invention's use of a low wattage heating element 20 also precludes residual heat buildup within the pipe section 70 should power be interrupted to the heater element 20 or pump. Shut-down upon power interruption is instantaneous and no water temperature in excess of 120° F. within the pipe section 70 or adjacent piping is possible. Therefore there is no possibility of scalding the user resulting from residual heat buildup caused by interrupted power. The control assembly 10 also incorporates the first pressure switch 32A as part of the circuit protecting the system from abnormal operating conditions caused by interrupted power, therefore, the user must initiate a manual action to remedy the unsafe condition before the heater element 20 can be returned to normal operating status.

The control device assembly 30 may also include the second pressure switch 32B that is normally closed. The second switch 32B preferably opens at 15 PSI and is used to protect the system from damage when the water flow through the heater assembly 10 is blocked on the outlet side 76. When the second switch 32B senses operating pressure in excess of 15 PSI (or other predetermined maximum flow threshold), the switch opens and interrupts power to the heating element 20. The second switch 32B cannot be automatically reset without the user first removing the blockage that caused the switch to react to an unsafe condition, regardless of any other of the circuits' components opening or closing.

Bath manufacturers have designated some, or in rare cases, all of their jets as "fully adjustable" to allow for the water flow directed from the jet to adjusted so that the flow is reduced by 80% or with some designs, be turned off completely. If multiple jets are used and only a portion are fully adjustable, a blocked flow condition would be avoided. However, if all are fully adjustable, water will cease to flow across the heater element and the heat in the heater assembly can rise to exceed 122° F. and if this were allowed to occur, a scalding potential would be present. The present invention's control assembly prevents this through the use of the second pressure switch 32B which senses the increased pressure in the heater assembly caused by the outlet side 76 of the heater assembly 10 being blocked (restricted) and when the pressure exceeds 15 PSI, the second pressure switch 32B opens immediately and interrupts all power to the heating element 20. Power to the heating element 20 cannot be restored by any other action other than a manual action by the user such as opening the jets to allow normal flow to resume.

Although the embodiment described above detailed a two-switch embodiment, it will be understood that a one-switch embodiment could be practice without departing from the teaching of the present invention. Structurally, a one-switch temperature maintenance device would be very similar to the two-switch embodiment. Only one switch fitting 43, pressure sensor aperture 56, pipe pressure sensor apertures 75, and diaphragm assembly need to be provided. Additionally either the hot lead 102 or the neutral lead 104 will be connected directly to a heating element 20 electrical contact 22. While the two-switch embodiment has the advantages associated with including normally closed second pressure switch 32B discussed below, the one switch device has many of the same advantages. In an alternative embodiment, a double pole switch may be used instead of a single pole switch. Additionally, while the two-switch embodiment above describes an embodiment with a normally closed switch used with a normally open switch, the invention may be practiced where all switches may be normally open, or normally closed.

It will be understood that while the embodiments described herein have described the first pressure switch 32A as being normally open, and on the outlet side of a pumping system, variations may be made without departing from the present invention. For instance, the first pressure switch 32A could operate in a similar manner if it were normally close and located instead on the suction side of the pumping system. In this alternative embodiment, the diaphragm assembly 60 would be constructed to respond to suction instead of positive pressure. So that the diaphragm assembly 60 will respond to the negative pressure accompanying normal operating conditions on the suction side of the pump, the diaphragm 62A would pull on the pressure sensor 38A via the spring 66A instead of pushing the sensor 38A.

In an alternative embodiment, the control device assembly 30 may further include a thermal sensor. Preferably, the thermal sensor is normally closed. This thermal sensor opens if the case temperature of the pipe section 70 exceeds the maximum allowable temperature. When in the tripped or open position, power is interrupted to the second pressure switch 32B and thus to the heating element 20. This thermal sensor may be an automatic reset device, but it does not act as the temperature-limiting control by itself. Rather, after it opens the circuit, if it resets without the system being returned to a normal safe operating condition by the user's manual action, the heater element 20 will still not energize. The thermal sensor will not open if either first pressure switch 32A or second pressure switch 32B are in a fault condition, unless a high case temperature is detected. As a high case temperature can only result when a high-pressure loss of flow unsafe condition (blockage) or a low-pressure loss of flow (low water, no water, pump cavitation, or low flow) unsafe condition is encountered (which are protected by either first pressure switch 32A or second pressure switch 32B), the temperature sensing capability is used only as a safety back-up in the case of failure of first pressure switch 32A or second pressure switch 32B.

Figure 10:
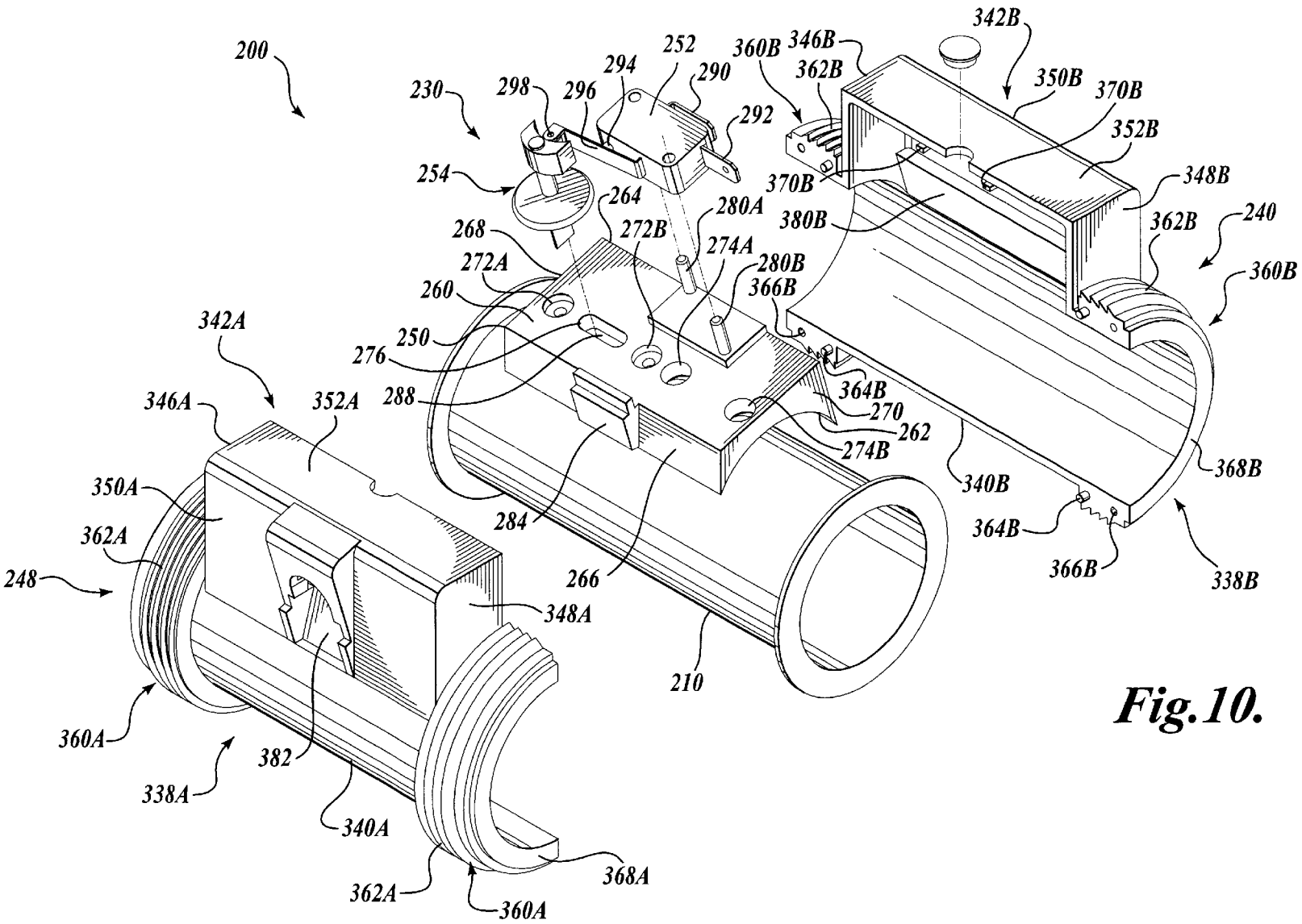
FIG. 10 is an exploded perspective view of an alternative embodiment of a bath temperature heater assembly constructed in accordance with the present invention.
Figure 11:
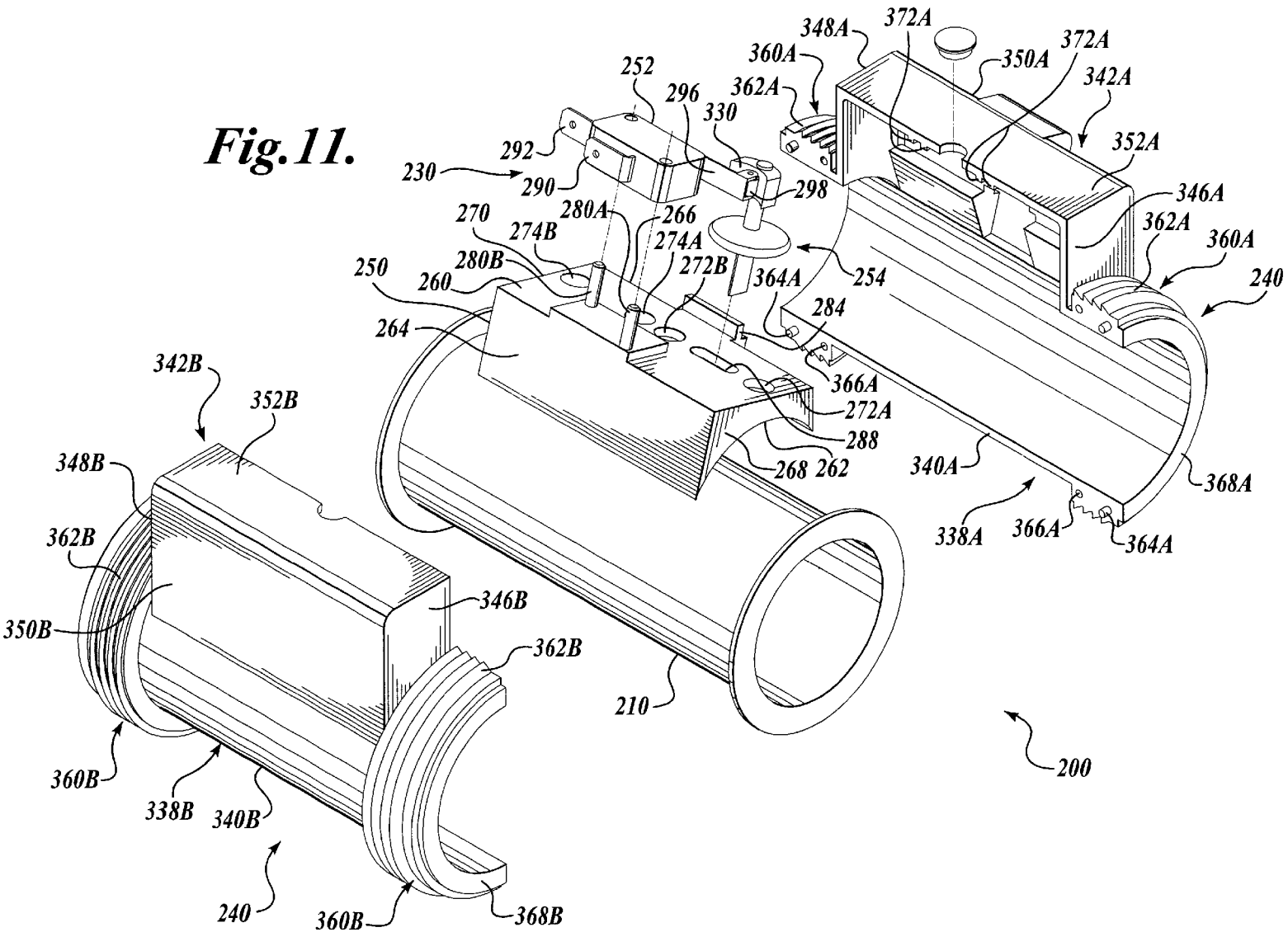
FIG. 11 is an exploded perspective view of the bath temperature heater assembly of FIG. 10, taken from the opposite side thereof.
Figure 12:
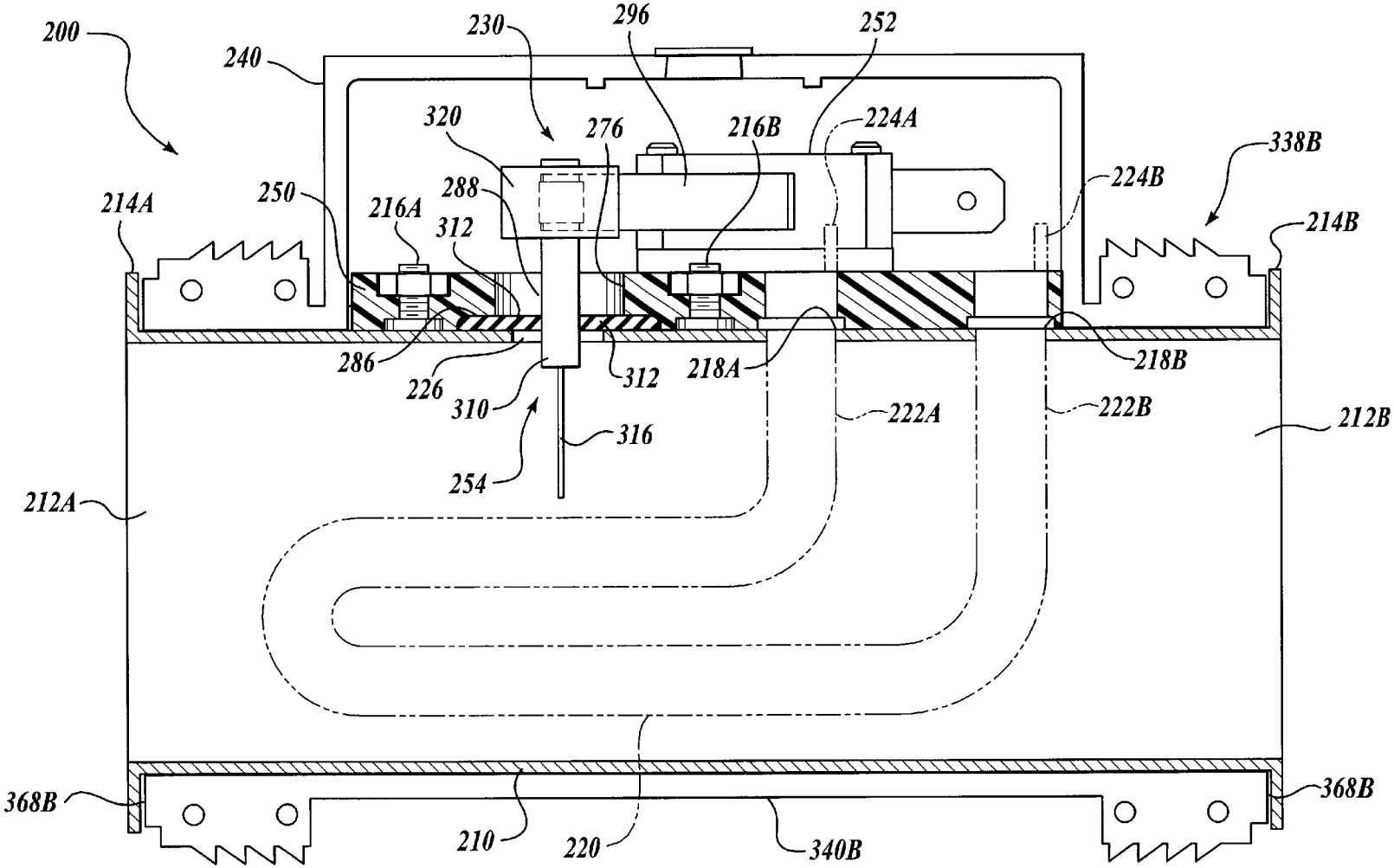
FIG. 12 is a cross-sectional view of the bath temperature heater assembly of FIG. 10 taken along its longitudinal axis.

Referring now to FIGS. 10–17, an alternative embodiment of a bath temperature maintenance heater 200 (hereinafter "heater assembly 200") constructed in accordance with aspects of the present invention is shown. As best shown in FIG. 12, the heater assembly 200 includes a heating element 220 housed within a pipe section 210 that is adapted to be installed in an associated piping of a jetted bath. The heater assembly 200 also includes a control assembly 230 for controlling the supply of power to the heating element 220. The control assembly 230 is mounted to the exterior of the pipe section 210 and housed within a cover 240. A power cord 390 (see FIG. 13) is electrically connected to the control assembly 230 to provide power to the heating element 220.

The pipe section 210 includes an inlet 212A and an outlet 212B, at which end flanges 214A and 214B are respectively formed. The pipe section 210 is preferably circular in cross-section and constructed of a suitable metallic material, such as stainless steel. Mounted to the exterior surface of the pipe section 210 along its longitudinal axis are externally threaded lugs 216A and 216B. The lugs 216A and 216B extend outward from the exterior surface of pipe section 210, and may be parallel to one another. The pipe section 210 further includes two apertures 218A and 218B adapted to receive the ends 222A and 222B of the heating element 220. Electrical contacts 224A and 224B of the heating element 220 are formed at the ends 222A and 222B of the heating element 220, respectively, and are suitably sized to be received by and extend through the apertures 218A and 218B. The pipe section 210 also includes an aperture 226 for receiving a portion of the switch actuator 254, as will be described in more detail below. The pipe section 210 may further include additional elements, such as an electrical bonding stud, not shown but well known in the art.

According to a feature of the heater assembly 200, the heating element 220 has a limited maximum power rating, which can be pre-selected based on the fluid capacity of the tub section of the bath and/or other variables, such as the size of the room where the bath is installed. In one embodiment, the upper range of the maximum power rating is approximately 700 watts.

Referring back to FIGS. 10 and 11, the control assembly 230 utilized by the heater assembly 200 for controlling the supply of power to the heating element will now be described in detail. In this embodiment, the control assembly 230 includes a base plate 250, a switch 252, and a switch actuator 254. Under certain operating conditions, such as low fluid flow (e.g., a flow rate below a pre-selected threshold value) through the pipe section 210, the switch 252 is tripped by the switch actuator 254 to interrupt power to the heater element. As will be described in more detail below, the switch 252 and switch actuator 254 cooperatively operate as a flow switch for determining a minimum threshold of fluid flow through the pipe section 210.

The base plate 250 of the control assembly 230 is used to mount the switch 252 onto the pipe section 210. The base plate 250 is generally rectangular in configuration and preferably constructed of a suitable plastic. The base plate 250 includes an upper surface 260, a lower surface 262, lateral and medial sides 264 and 266, and front and back sides 268 and 270. The base plate 250 includes apertures passing from the lower surface 262 to the upper surface 260, including the first and second lug apertures 272A and 272B, and first and second electrical contact apertures 274A and 274B. The lug apertures 272A and 272B are spaced apart along the longitudinal dimension of the base plate 250. The lug apertures 272A and 272B are suitably sized to receive the pipe section lugs, and may be counterbored at the upper surface 260 to receive correspondingly sized nuts to securely mount the base plate 250 to the pipe section 210. The electrical contact apertures 274A and 274B are also spaced a distance apart along the longitudinal dimension of the base plate 250 and are suitably sized to receive the ends of the heating element. To provide a water-tight environment for the control assembly 230, any gaps between the ends of the heating element and their respective apertures and openings may be sealed with any commonly known sealant, welding, or by the use of ring seals, bulkheads and corresponding nuts, or the like.

The base plate 250 further includes a switch actuator aperture 276 disposed between the lug apertures 272A and 272B. As best shown in FIG. 12, the switch actuator aperture 276 has a circular bottom section 286 opening to the lower surface of the base plate 250, and an elongate slot 288 that extends along the longitudinal dimension of the base plate 250. The bottom section 286 is suitably sized to seat a diaphragm 312 of the switch actuator 254 therein. As will be described in more detail below, the elongate slot 288 acts as a guide and a stop for guiding the switch actuator 254 along a longitudinal path of travel and for limiting the distance of actuator travel.

Returning back to FIGS. 10 and 11, the upper surface 260 of the base plate 250 is generally planar and includes spaced-apart switch mounting posts 280A and 280B. The mounting posts 280A and 280B are circular in cross section and extend orthogonally away from the planar upper surface 260 of the base plate 250. The lower surface 262 of the base plate 250 has a radius of curvature, which corresponds to the radius of curvature of the circular pipe section 210. As can be seen in the embodiment shown, the lateral side 264 of base plate 250 extends downwardly from the upper surface 260 a larger distance than the medial side 266. The medial side 266 has an inward slanting side wall and a centrally located power cord fitting 284, the function of which will be described in more detail below.

The base plate 250 creates a mounting structure for mounting the switch 252 to the pipe section 210. The switch 252 is adapted to be mounted to the mounting posts 280A and 280B and may be secured in place by suitable nuts (not shown). The switch 252 includes electrical contacts 290 and 292, a push button 294 (not shown in FIG. 11), and a lever arm 296 having a cam follower 298 mounted at its end. The lever arm 296 is secured to the switch 252 at one end and extends along the longitudinal dimension of the switch 252 to a free end at the location of the cam follower 298. Thus, the lever arm 296 pivots about its secured end. In the embodiment shown, the push button 294 abuts against the inner side surface of the lever arm 296 at approximately its midsection. One such switch 252 which may be suitable for use by the control assembly 230 of the present invention is model VMN 10Q-06, sold by Zippy Technology Corp., of Taipei, Taiwan. Thus, the switch 252 will not be described in any more detail. The cam follower 298, disposed at the end of the lever arm 296, faces away from the body of the switch 252 and contacts a cam surface of a switch guide member, as will be described in more detail below.

Referring now to FIGS. 12–16B, the switch actuator 254 is operable to change the state of the switch 252 regardless of the direction of fluid flow through the pipe section. The switch actuator 254 is pivotally connected at the junction between the base plate 250 and the outer surface of the pipe section 210 by the diaphragm 312, shown best in FIGS. 12 and 13. The switch actuator 254 is pivotally movable from an at-rest position, shown in FIG. 15A, wherein the fluid flow through the pipe section is less than the pre-selected threshold value, to the positions illustrated in either FIGS. 14A or 16A, wherein the fluid flow through the pipe section is greater than or equal to the pre-selected threshold value. In one embodiment, the pre-selected threshold value is about 2 PSI, which is equivalent to about six gallons per minute for the diameter of the pipe section used in this particular assembly.

Figure 13:
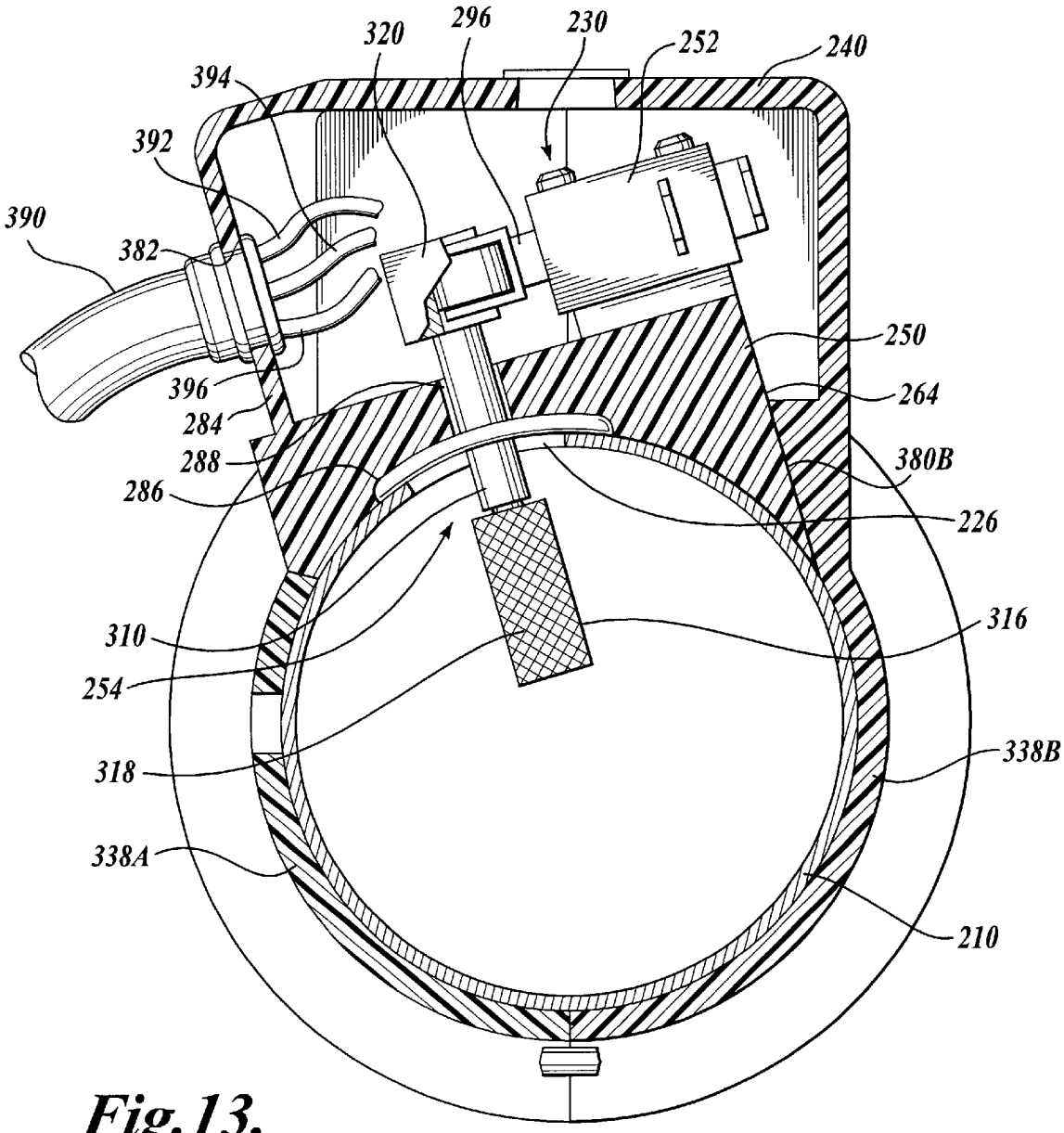
FIG. 13 is a cross-sectional view of the bath temperature heater assembly of FIG. 10 taken along its minor axis.
Figure 14A:
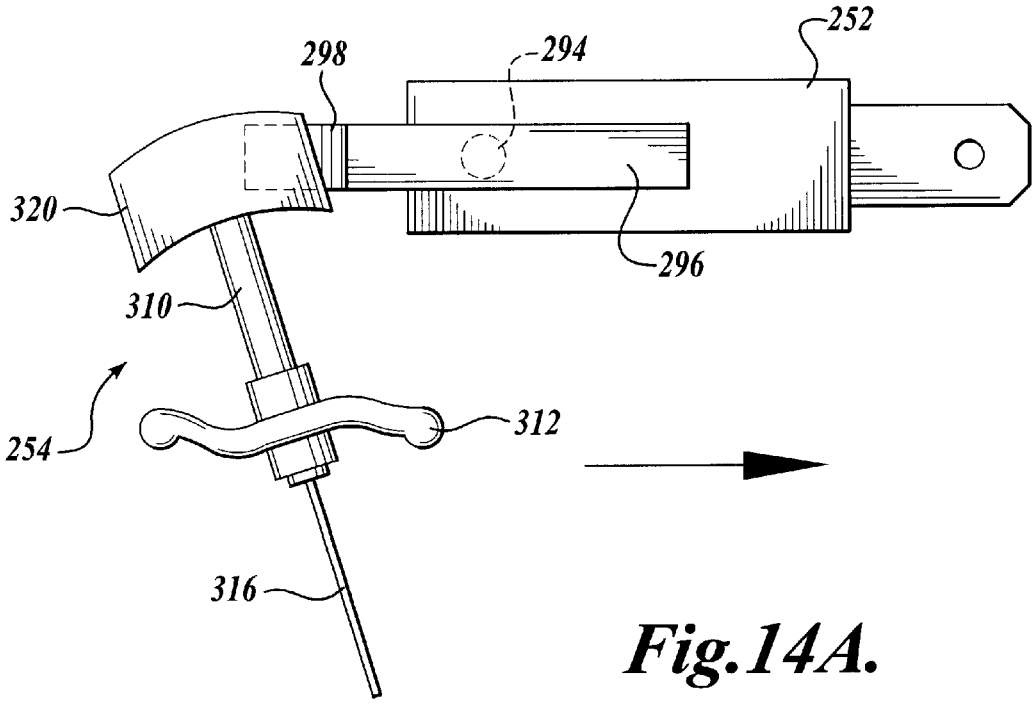
FIGS. 14A–14B, 15A–15B, and 16A–16B are schematic representations of the positions of the switch actuators depending of the direction and amount of fluid flowing through the pipe section.
Figure 14B:
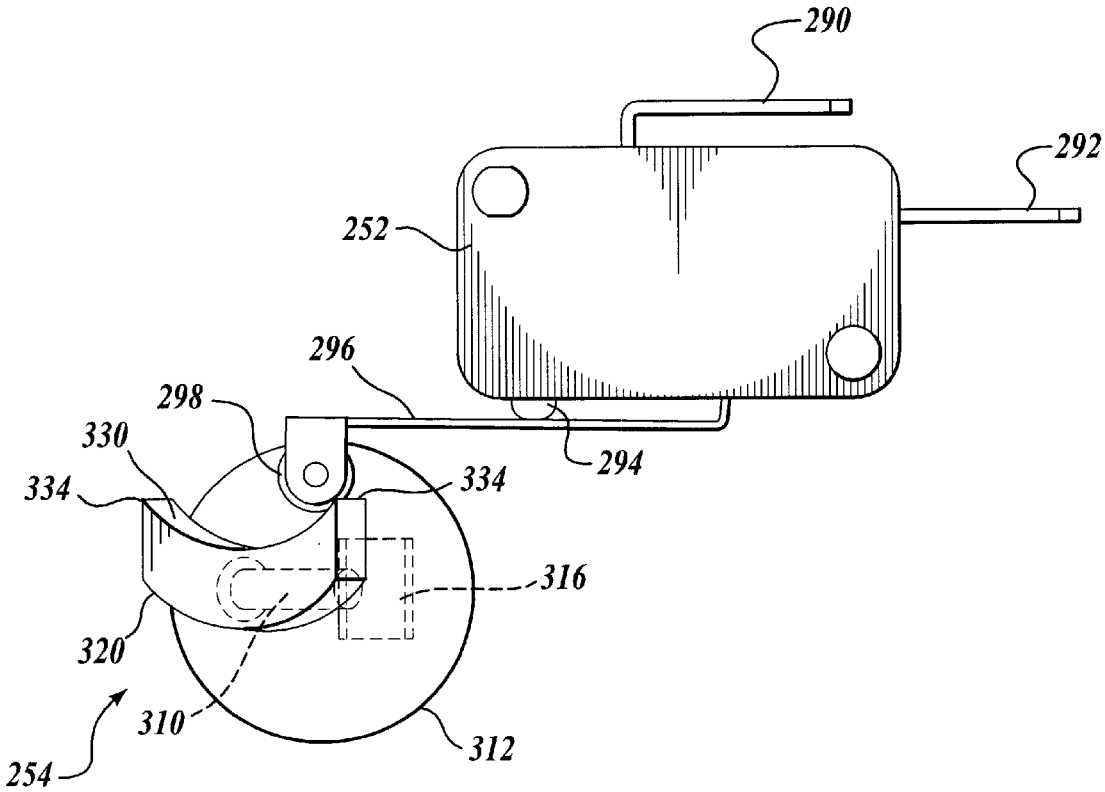

Referring now to FIGS. 12 and 13, the switch actuator 254 includes an elongate shaft portion 310. When assembled, one end of the shaft portion 310 extends through aperture 226 and into the interior of the pipe section 210, while the other end extends through the aperture 276 (see FIG. 12) comprised of the bottom section 286 and elongate slot 288 such that the end is adjacent to the lever arm 296 of the switch 252. A paddle 316 is formed at the end partially extending into the pipe section 210, while a switch guide member 320 is mounted to the switch end of the shaft 310. The paddle 316 has generally planer side surfaces or fluid contact surfaces 318 (see FIG. 13), which are perpendicular to the direction of fluid flow when assembled. In the embodiment shown in FIG. 13, the paddle 316 has a generally rectangular shape; however, it will be appreciated that other shapes, such as circular, may be used. As will be described in more detail below, the size and configuration of the fluid contact surfaces 318 of the paddle 316 are selected such that enough force is exerted against the paddle 316 when an adequate flow (i.e., the flow rate though the pipe is equal to or exceeds the pre-selected threshold value) is present to pivot the switch actuator 254 about a horizontal axis of the diaphragm 312 to a position necessary to change the state of the switch 252. As will be described in more detail below, the diaphragm 312 is designed in conjunction with the paddle fluid contact surfaces 318 to allow the switch actuator 254 to pivot to a position necessary to change the state of the switch 252 in the presence of adequate flow, and to return to a vertical position in the presence of inadequate flow (i.e., below the threshold value).

Figure 15A:
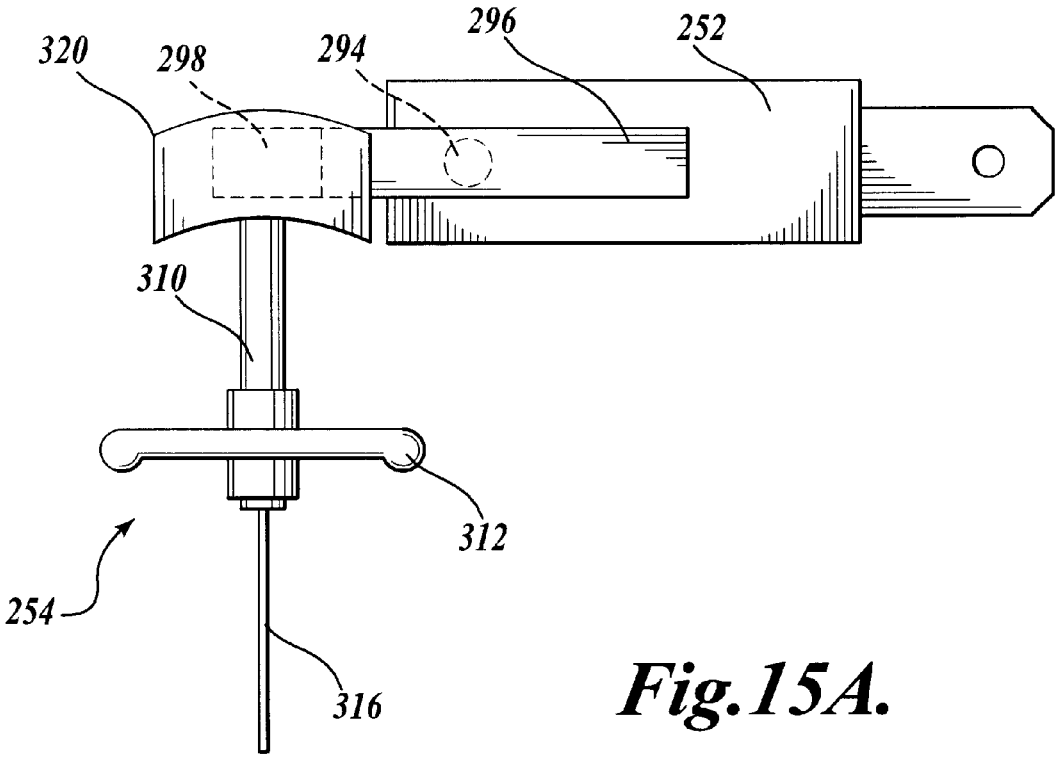
Figure 15B:
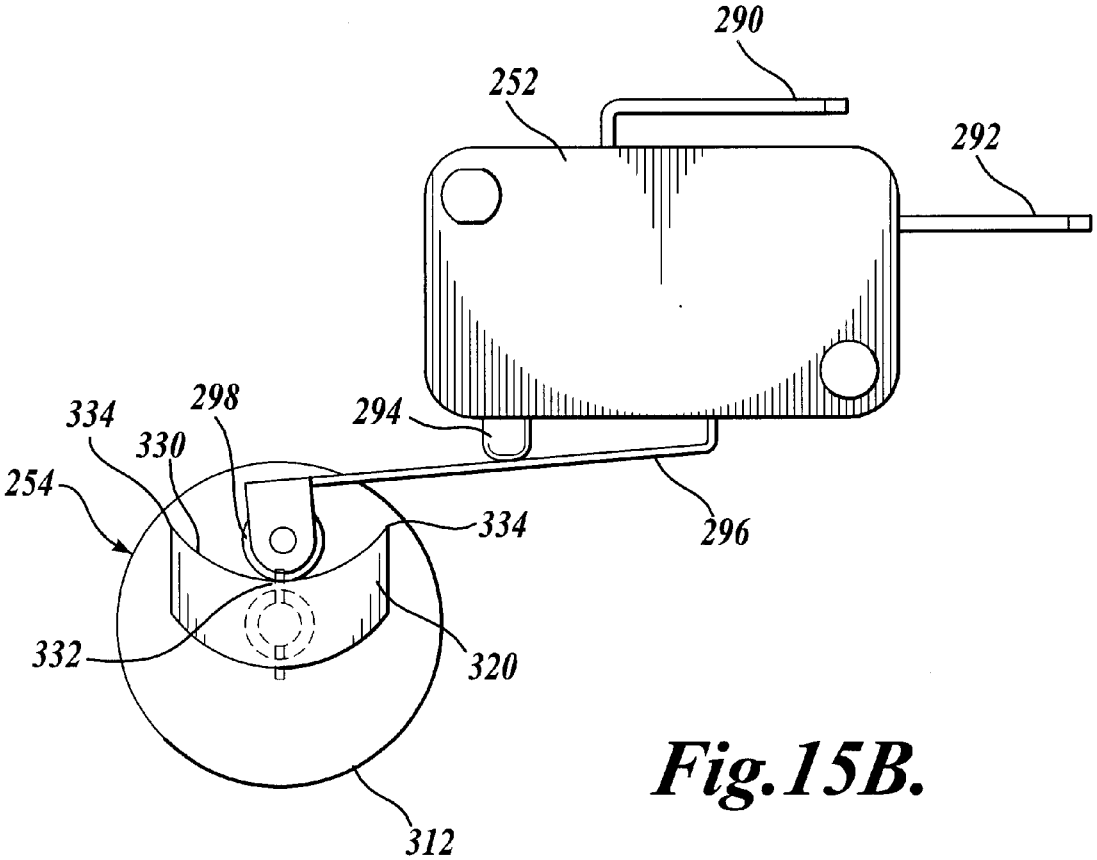
Figure 16A:
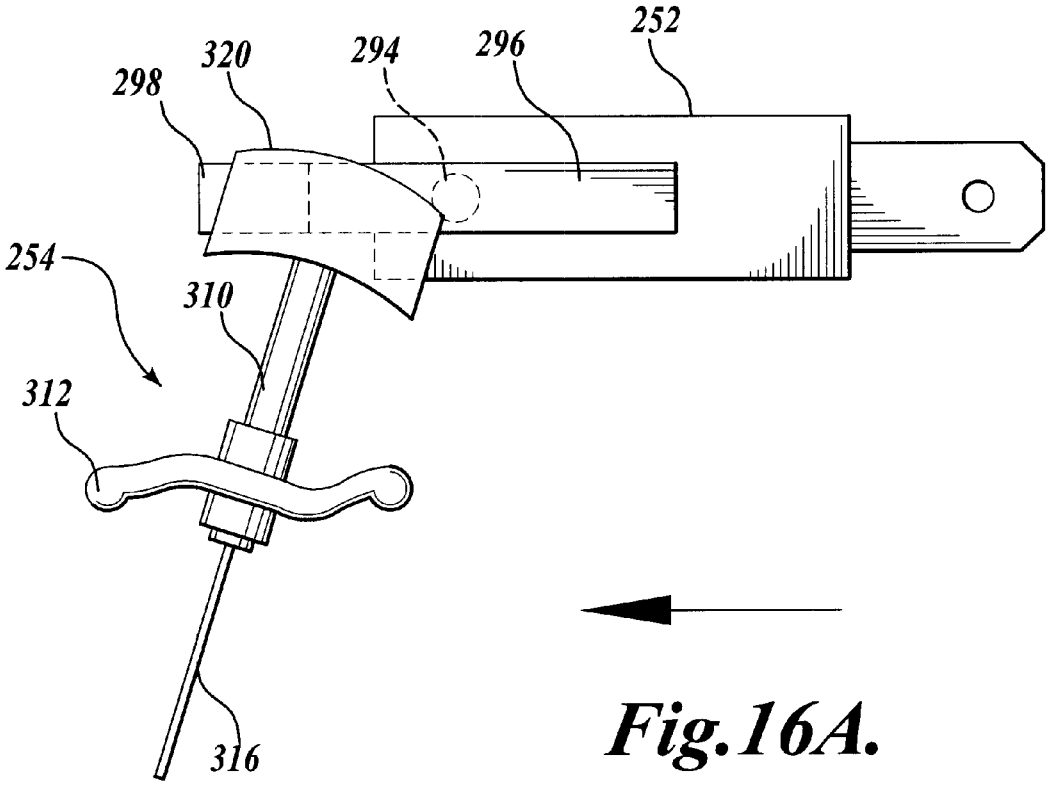
Figure 16B:
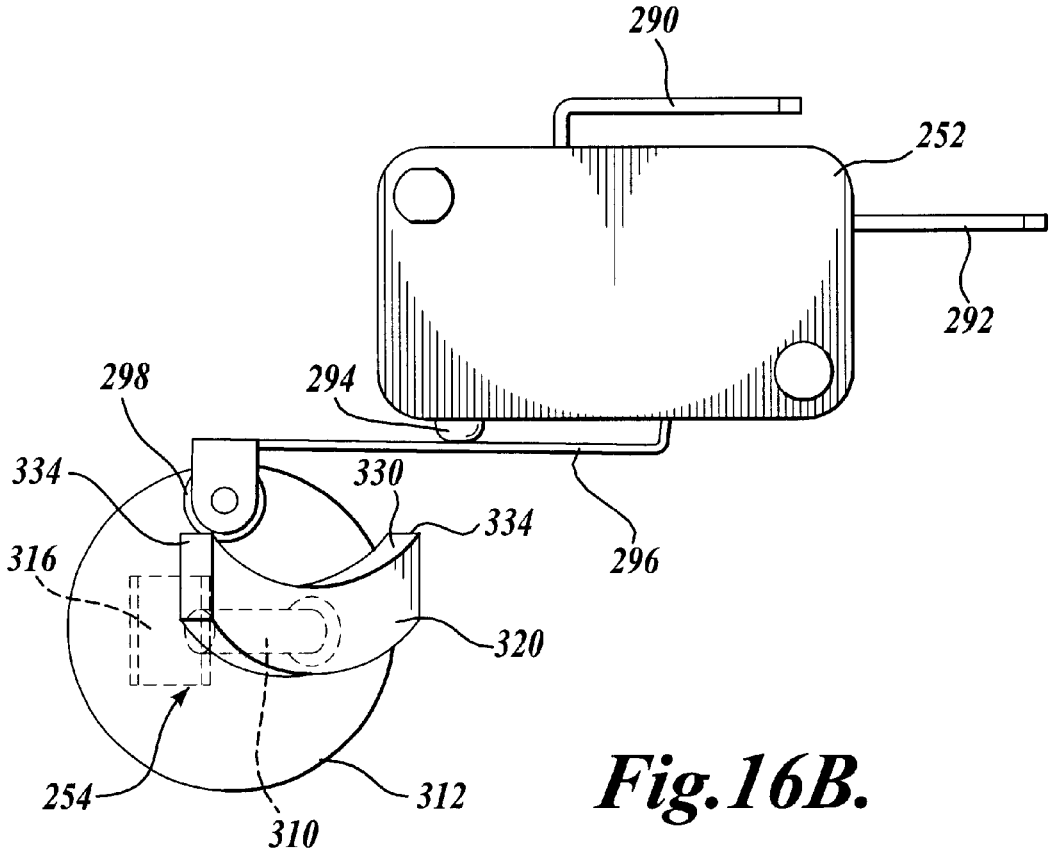

As shown best in FIGS. 15B, the switch guide member 320 has a generally crescent body having a concave cam surface 330 defining a middle portion 332, and end portions 334. When assembled, the middle portion 332 of the cam surface 330 is disposed a farther distance away from the switch 252 than the ends portions 334. The switch guide member 320 is connected to the end of the shaft 310 (see FIG. 15A) by any conventional fastening techniques, such as press fitting or the like. When assembled, the concave cam surface 330 of the switch guide member 320 contacts the cam follower 298 of the switch 252.

Referring back to FIGS. 12 and 13, the switch actuator 254 is pivotally connected to the heater assembly by the diaphragm 312. The diaphragm 312 is generally disc-shaped and formed from a suitable polymeric or elastomeric material, such a rubber. The diaphragm 312 is secured to the shaft 310 in a leak-proof manner at approximately its midsection. The diaphragm 312 is suitably sized to seat within the bottom section 286 and to overlap the aperture 226 in the pipe section 210. When assembled, the pressure generated by fluid flowing through the pipe section 210 forces the diaphragm 312 against the bottom section 286 of the base plate 250, thereby forming a seal.

As was briefly described above, certain design variables of the diaphragm 312, for example, stiffness of the material, thickness, and cross-sectional configuration, may be selected in conjunction with the size of the fluid contact surfaces of paddle 316 (a paddle with a larger fluid contact surface will pivot at a lower flow rate, whereas a paddle with a smaller fluid contact surface will pivot at a higher flow rate) such that the following conditions are met: 1) The switch actuator 254 pivots to a position that changes the state of the switch 252 when introduced to a flow rate greater than or equal to the pre-selected threshold value; and 2) The switch actuator 254 returns to the at-rest position by the biasing force of the diaphragm 312 when the fluid flow falls below the pre-selected threshold value. Thus, for any desired threshold value, the design variables of the diaphragm 312 and the size of the paddle fluid contact surface 318 (see FIG. 13) can be manipulated to satisfy the conditions stated above.

The heater assembly 200 of the alternative embodiment further includes a cover 240, which provides a watertight environment for housing the control assembly 230. As best shown in FIGS. 10 and 11, the cover is split by an imaginary plane, bisecting the cover into two half sections 338A and 338B. The cover half sections 338A and 338B include elongate tubular lower portions 340A and 340B and generally rectangular top portions 342A and 342B. The top portion 342A of the section half 338A has end walls 346A and 348A, side walls 350A, and a top wall section 352A, while the top portion 342B of the section half 338B has end walls 346B and 348B, side walls 350B, and a top wall section 352B. The elongate tubular lower portions 340A and 340B are suitably sized in cross-section to surround the pipe section 210, and to allow the cover to slide over the pipe section 210.

At the ends of each elongate lower portion 340A and 340B are externally threaded fittings 360A and 360B, respectively. The threaded fittings 360A and 360B include respective threaded portions 362A and 362B, locking pins 364A and 364B, locking apertures 366A and 366B, and a flange-mating surfaces 368A and 368B. The threaded portions 362A and 362B have external threads sized and configured to communicate with internal threads of a one-piece nut (not shown) for connecting the heater assembly to the piping of the jetted bath. The external threads may be optionally formed with non-standard dimensions with regard to thread pitch and size to prohibit unauthorized attachment of the heater assembly to the jetted bath. The locking pins 364A and 364B and locking apertures 366A and 366B are located along the surface dividing the two halves 338A and 338B of the cover 240. The pin and apertures of each respective half section 338A and 338B are suitably positioned to provide an alignment mechanism to sufficiently align the half sections together when assembled. Further, as shown in FIG. 12, the lower portion 340A and 340B of the section halves 338A and 338B (only section half 338B is shown in FIG. 12) are suitably sized in the longitudinal dimension to extend between the end flanges 214A and 214B of the pipe section 210 such that a flange-mating surfaces 368B either abuts against or is disposed adjacent to the end flanges 214A and 214B of the pipe section 210 when assembled.

Referring back to FIGS. 10 and 11, the top portions 342A and 342B are suitably sized and configured to house the control assembly 230 when assembled. As shown in FIG. 10, the top portion 342B may include integrally formed ribs 370B, spaced a distance apart and extending downwardly from the inside surface of the top wall section 352B and outwardly away from the cover section half 338B. As shown in FIG. 11, the other top section 342A may include two corresponding elongate rib sections 372A for each rib section 370B (see FIG. 10). The elongate rib sections 372A extend downwardly from the inner surface of the top wall section 352A to form slots therebetween. The slots are suitably positioned such that the slots receive the protruding elongate rib sections 370B of the section half 338B (see FIG. 10) when assembled. Thus, the rib sections 370B (see FIG. 10) and 372A (see FIG. 11) also provide an alignment mechanism to align the half sections together. Once the half sections 338A and 338B are mated together to surround the pipe section 210 and the control assembly 230, the section halves are secured together and sealed to provide a watertight cavity. The section halves may be secured together and sealed by any conventional method, such as ultrasonic welding, adhesives, screws, or pressure fitting, to name a few.

Referring now to FIGS. 10 and 13, the top section of half section 338B further includes an integrally formed inner sidewall 380B. The inner sidewall 380B is slanted in a downward sloping manner. When assembled, the base plate 250 and the pipe section 210 are rotated to a position such that the sidewall 380B abuts against the lateral side 264 of the base plate.

Still referring to FIGS. 10 and 13, the top section of half section 338A may include a power cord aperture 382 for receiving a portion of the power cord fitting 284. The power cord aperture 382 is disposed in the sidewall 350A (see FIG. 10) and includes a generally rectangular shaped bottom portion, and a smaller semi-circular shaped top section. The bottom section of the aperture 382 corresponds to and accepts the power cord fitting 284, such that when the base plate 250 and the cover section half 338A are joined together about the power cord 390, the power cord 390 is pushed into the semi-circular top portion of the aperture 382 and partially sealed, as best shown in FIG. 13.

Figure 17:
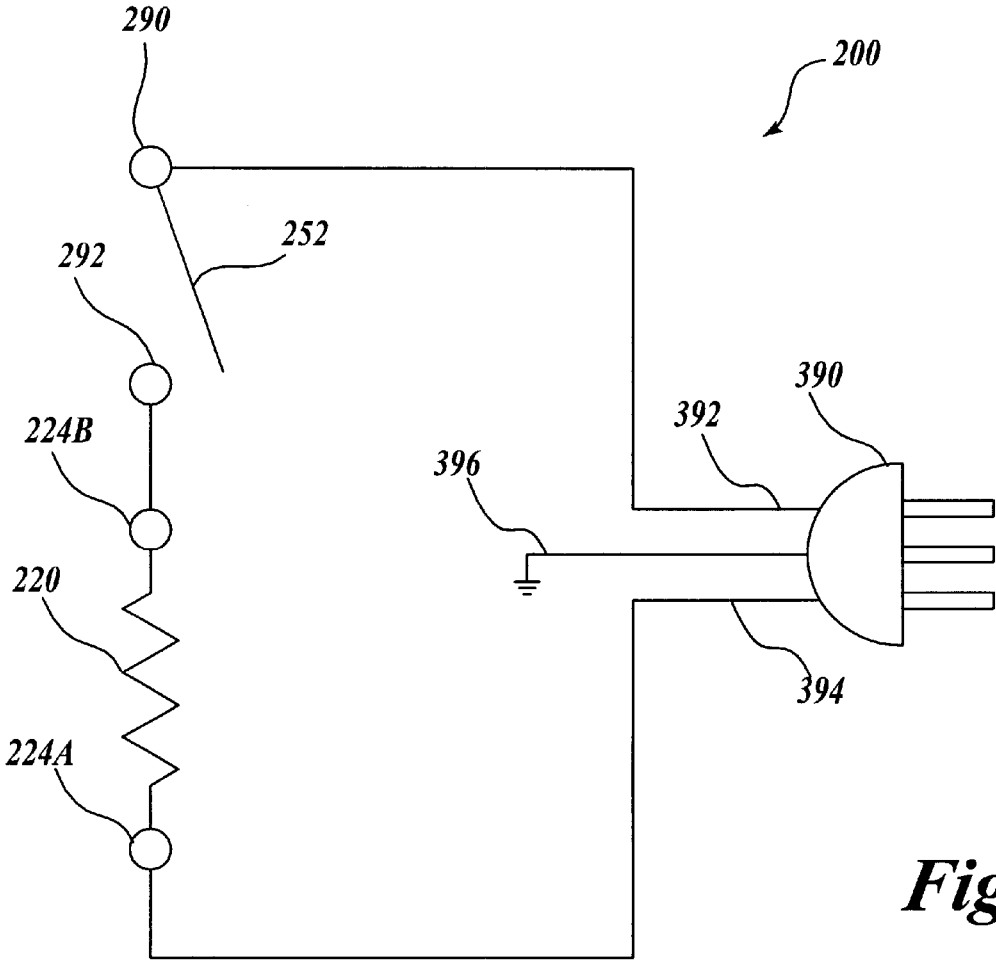
FIG. 17 is a circuit diagram of the alternative embodiment of the electrical components of the bath temperature heater assembly of FIG. 10.

The heater assembly 200 may further include the power cord 390 for supplying power to the heating element, as best seen in FIG. 13. The power cord 390 includes a hot lead 392, a neutral lead 394, and a ground lead 396. The hot and neutral leads 392 and 394 may connected to the electrical contact 290 of the switch 252 and the electrical connection 224A of the heating element 220, respectively, as best shown in FIG. 17. The ground lead 396 may ground the heater assembly by conductively connecting to one of the lugs 216A and 216B (see FIG. 12) attached to the pipe section 210. When assembled, the power cord 390 is sealed by the power cord aperture 382 and secured into place to provide a stain relief by the power cord fitting 284 of the base plate 250.

The heater assembly 200 physically embodies a circuit, which can be represented by the circuit diagram of FIG. 17. As best shown in FIG. 17, the heater assembly 200 includes the heating element 220 and the switch 252 of the control assembly, which includes first and second electrical contacts 290 and 292. The circuit diagram here shows the switch 252 in series arrangement with the heating element 220; however, it will be understood however that the switch 252 may alternatively be configured in parallel with the heating element 220.

The heating element 220 includes first and second electrical contacts 224A and 224B. The second electrical contact 292 of the switch 252 is electrically connected to the heating element second electrical contact 224B, the connection being physically embodied by an electrically conductive jumper (not shown in any of the FIGURES). The first electrical contact 290 of the switch 252 is connected to the hot lead 392 of the power chord 390, and the heating element first electrical contact 224A is connected to the neutral lead 394 of the power chord 390. It will be understood that the neutral lead 394 could alternatively be connected the switch 252, and the hot lead 392 connected to the heating element 220. Thus, the switch 252 acts to interrupt the supply of electricity from a power supply via the power cord 390 to the heating element 220.

The operation of the heater assembly 200 will now be described with reference to FIGS. 10–17. First, the heater assembly 200 is assembled and secured into place by the externally threaded fittings 360A and 360B. When assembling the cover half sections 338A and 338B after the base plate 250 is secured to the pipe section 210, the pipe section 210 is rotated such the slanted side wall 380 of the cover half section 338B abuts against the lateral side wall 264 of the base plate 250.

Once the heater assembly 200 is secured into place, power to the pump may be initiated so that fluid may flow through the pipe section 210. It will be appreciated that the pump draws fluid contained in the bathtub section of the bath through exit ports and into the pipe section 210. Under normal operating conditions, i.e., the fluid flow rate is greater than or equal to the pre-selected threshold value, the switch actuator 254 pivots about a horizontal axis of the diaphragm 312 from its at-rest position shown in FIGS. 12 and 15A to one of the positions shown in either FIG. 14A or 16A, depending on the direction of flow of the fluid (shown by arrows). When the switch actuator 254 pivots to the positions shown in either FIG. 14A or 16A, power is supplied to the heating element 220. As was described above, the diaphragm 312 and the paddle 316 are designed cooperatively to allow the switch actuator 254 to pivot to the necessary positions when adequate flow is present in the pipe (i.e., the threshold value as been met).

It will be appreciated that the threshold value of approximately 2 PSI or 6 gallons per minute applies to only one embodiment, and thus should not be construed as limiting the scope of the present invention. Therefore, it will be apparent that other hydromassage or spa systems that may utilize the heater assembly 200 may require a different threshold value. Accordingly, it will be apparent that a change in the threshold value may affect the size of the paddle fluid contact surface, and the construction (thickness, cross-section, and shore value) of the diaphragm 312.

During normal operating conditions, the switch actuator 254 pivots away from the at-rest position, shown best in FIGS. 12 and 15A–15B. When the switch actuator 254 pivots, it is restricted to move along the longitudinal axis of the pipe section 210 due to the elongate slot portion 288 of the base plate aperture. As the switch actuator 254 pivots and is stopped by the end of the slot portion 288, the switch guide member 320 mounted at the top of the switch actuator 254 translates such that the cam follower 298 of the switch 252 moves along the cam surface 330 of the switch guide member 320. In the position shown in FIGS. 14B and 16B, the end portion 334 of the cam surface 330 forces the cam follower 298 toward the body of the switch 252, which in turn, causes the lever arm 296 the move toward the body of the switch 252. As the lever arm 296 moves toward the body of the switch 252, the push button 294 is depressed and the switch 252 changes states from open, when the switch actuator 254 is in the at-rest position, to closed. Once the switch 252 is in the closed position, power may be supplied to the heating element 220.

If an abnormal condition is present where the fluid flow through the pipe section 210 drops below the threshold value, the biasing force of the diaphragm 312 along with the curvature of cam surface 330, causes the switch actuator 254 to return to the at-rest position shown in FIGS. 15A–15B. At the same time, the switch guide member 320 translates along the longitudinal axis of the pipe section 210, causing the cam follower 298 to move along the cam surface 330. Once the switch actuator 254 has achieved the at-rest position, the cam follower 298 engages against the middle portion 332 of the cam surface 330, as best shown in FIG. 15B. Since the middle portion 332 is located further away from the body of the switch 252 than the end portions 334, the cam follower 298 translates outwardly away from the body of the switch 252, which in turn, causes the lever arm 296 the move away from the body of the switch 252. As the lever arm 296 moves away from the body of the switch 252, the push button 294 is released and the switch 252 changes states from a closed position, when the switch actuator 254 is in the actuated position, to an open position. Once the switch is in the open position, power is interrupted to the heating element. Thus, the switch 252 interrupts the power to the heating element when the fluid flow through the pipe section drops below the pre-selected threshold value.

Thus, the heater assembly provides a temperature-limiting control to a jetted bath while maintaining a desired bath temperature range by the use of a flow switch in conjunction with the heating element having a limited maximum power rating. The flow switch, which is composed of the switch actuator and the switch, is configured to respond to abnormal conditions, which are flow related. When the flow switch determines the existence of an abnormal condition, power to the heating element is interrupted, thereby limiting the temperature of the water circulating through the bath. Additionally, by the use of a heating element with a limited maximum power rating, not only does the power rating more closely match the heat loss of the bath water to the ambient temperature of the air and through the tub section walls than conventional temperature maintenance heaters, the low wattage heating element also precludes residual heat buildup within the pipe section should power be interrupted to the heating element or the pump. Shut-down upon power interruption is instantaneous and no water temperature in excess of 120° F. within the pipe section or adjacent piping is possible due to the limited power rating of the heating element. Therefore, there is no possibility of scalding the user resulting from residual heat buildup caused by interrupted power. Accordingly, it will be appreciated that the heater assembly may be, and preferably is, practiced in the absence of a temperature-regulating device, such as a thermostat and/or a high limit switch.

Figure 18:
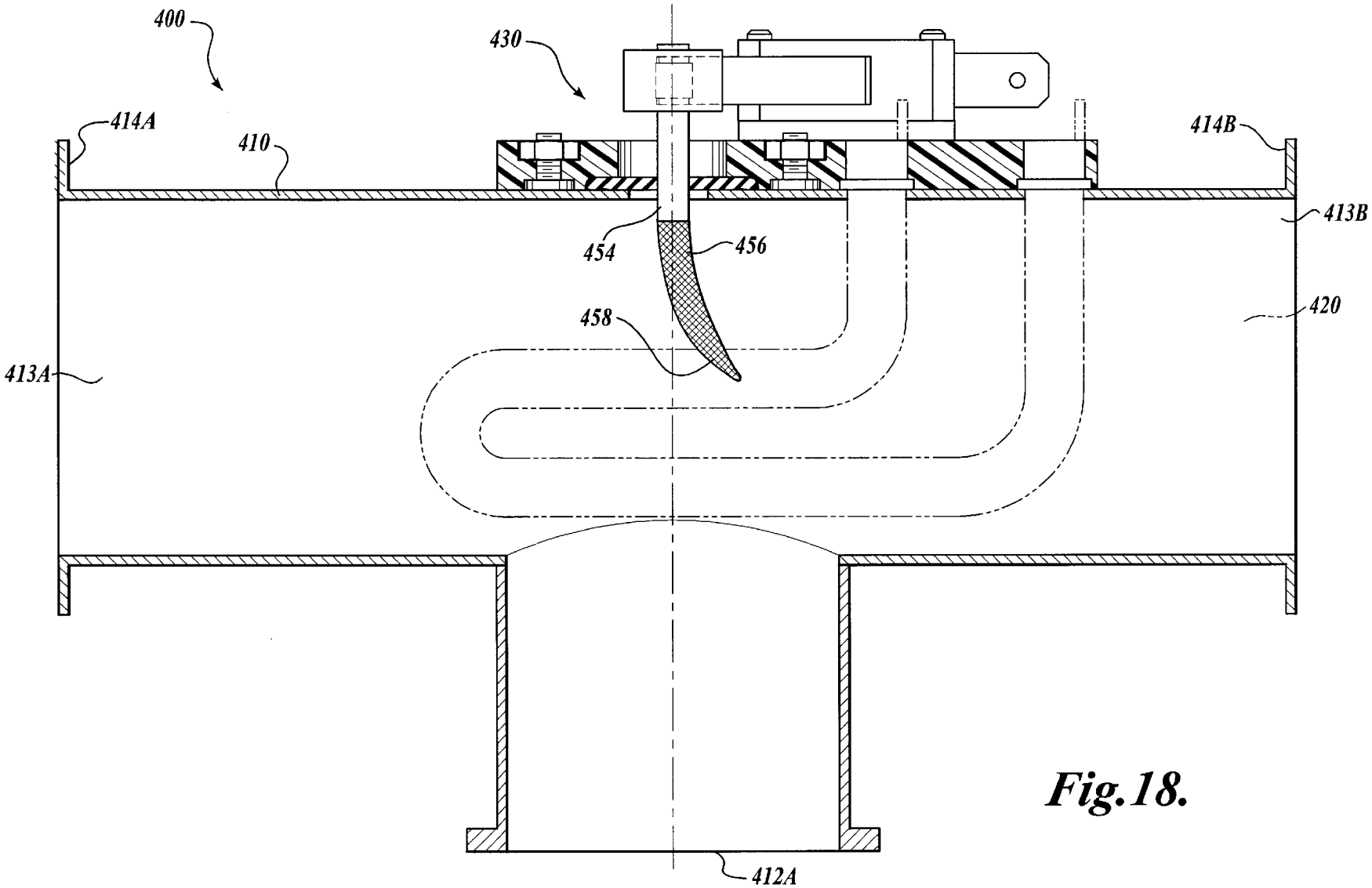
FIG. 18 is a longitudinal cross-sectional view of another alternative embodiment of the bath temperature heater assembly formed in accordance with the present invention, wherein the switch is in a open state.

Turning now to FIG. 18, an alternative embodiment of a bath temperature maintenance heater 400 (hereinafter "heater assembly 400") constructed in accordance with aspects of the present invention is shown. The embodiment of FIG. 18 is substantially identical in materials, construction, and operation to the invention described above in FIGS. 10–17 except for the differences, which will now be described. The heater assembly 400 includes a heating element 420 housed within a T-shaped pipe section 410 that is adapted to be installed in an associated piping of a jetted bath. The heater assembly 400 also includes a control assembly 430 for controlling the supply of power to the heating element 420. The control assembly 430 is mounted to the exterior of the pipe section 410 and housed within a cover (not shown). It will be apparent that a cover of heater assembly 400 will be slightly modified from the cover of heater assembly 200 described above with reference to FIGS. 10 and 11 to accommodate the T-shaped pipe section 410.

The pipe section 410 includes an inlet 412A and two outlets 413A and 413B, at which end flanges 414A and 414B are respectively formed. The pipe section 410 is preferably circular in cross-section and constructed of a suitable metallic material, such as stainless steel. The control assembly 430 is mounted to the outer surface of the T-shaped pipe section 410 directly opposite of the inlet 412A by any of the methods described above. The control assembly 430 is preferable positioned such that the paddle 456 is substantially coaxial with the inlet 412A, as shown in FIG. 18. The paddle 456 has a curved fluid contact surface 458 that faces in the direction of the outlet 413A. It will be appreciated that the paddle 456 can be oriented such that the curved fluid contact surface 458 faces in the direction of outlet 413B.

The operation of the heater assembly 400 will now be described with reference to FIGS. 18 and 19. FIG. 18 is a longitudinal cross-section view of the heater assembly 400, wherein the switch actuator 454 is in the at-rest position and the supply of power to the heating element 420 has been interrupted.

Figure 19:
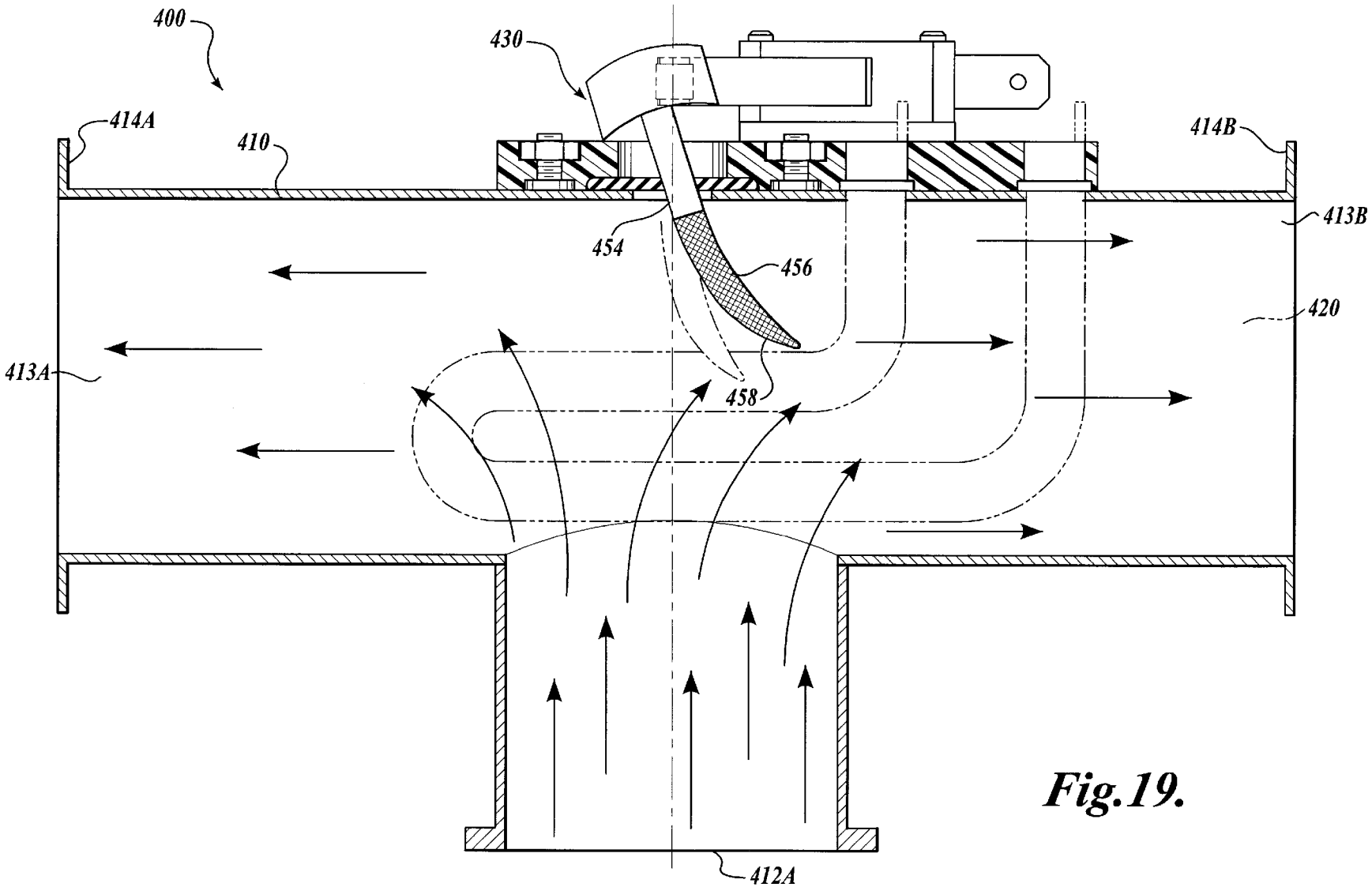
FIG. 19 is a longitudinal cross-sectional view of the bath temperature heater assembly of FIG. 18, wherein the switch is in a closed state.

Under normal operating conditions, i.e., the fluid flow rate is greater than or equal to the pre-selected threshold value, fluid enters the inlet 412A from a pump (not shown) and flows through the pipe section 410 as shown by the arrows in FIG. 19. As the fluid flows through the pipe section 410, the fluid contacts the curved fluid contact surface 458 of the paddle 456. Due to the force of the fluid flow against the curved fluid contact surface 458, the switch actuator 454 pivots in the direction of outlet 413B, thereby changing the state of the switch from open, when the switch actuator 454 is in the at-rest position shown in FIG. 18, to closed, when the switch actuator 454 has moved in the direction of the outlet 413B shown in FIG. 19. Once the switch is in the closed state, power may be supplied to the heating element 420.

If an abnormal condition is present where the fluid flow through the pipe section 410 drops below the threshold value, the switch actuator 454 returns to the at-rest position shown in FIG. 18, due to the biasing force of the diaphragm and the cam surface of the switch guide member. In the at-rest position, the switch is in an open state and power to the heating element 420 is interrupted.

Figure 21:
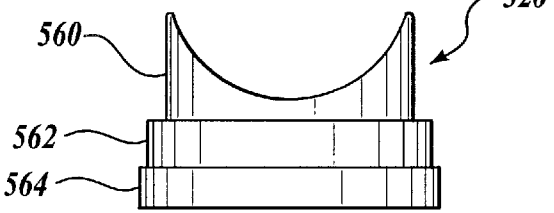
FIG. 21 is a side elevational view of a pipe branch of the T-shaped pipe section illustrated in FIG. 20.
Figure 20:
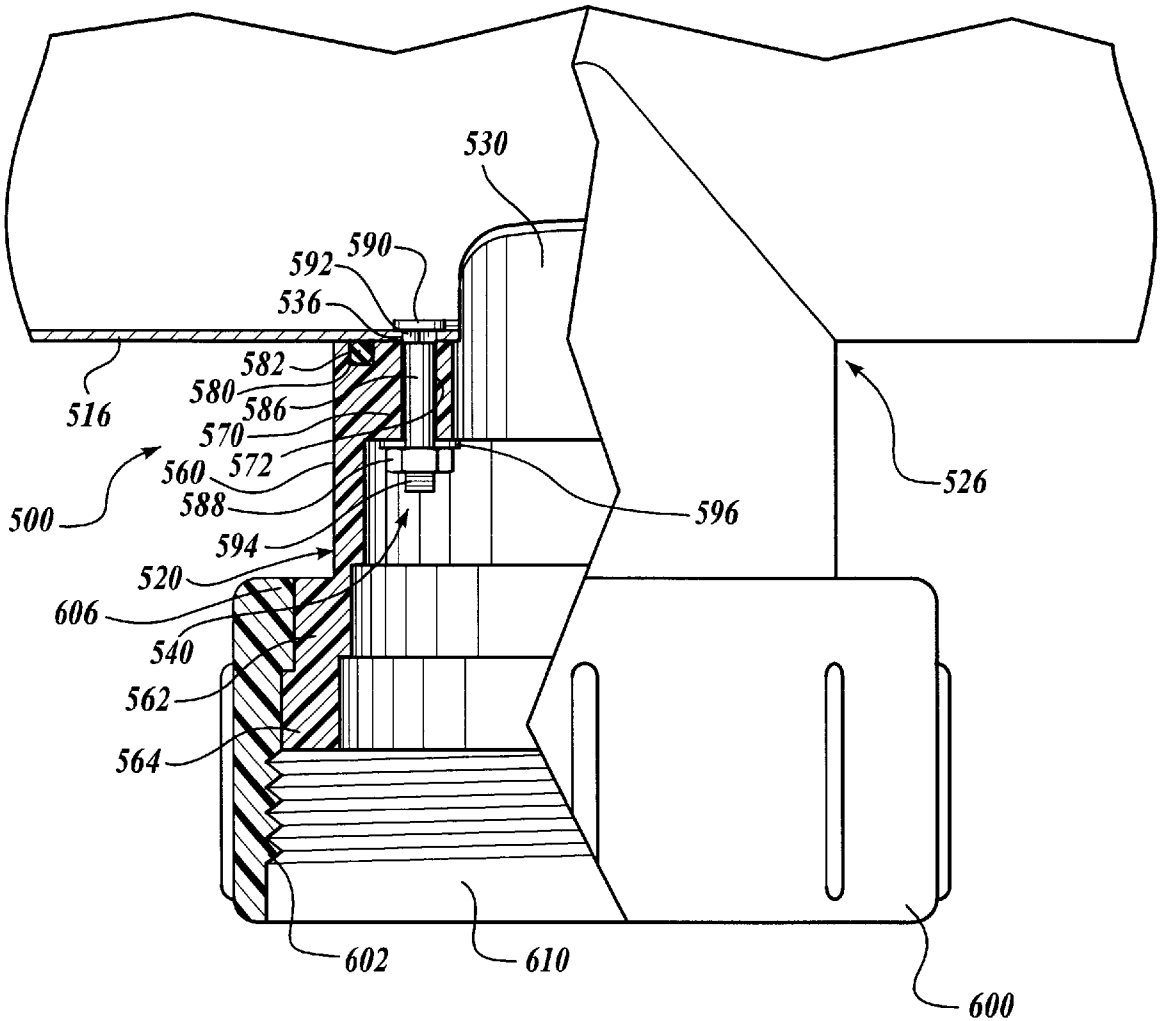
FIG. 20 is a partial cross-sectional view of a T-shaped pipe section formed in accordance with aspects of the present invention.

In accordance with another aspect of the present invention, one suitable embodiment of a T-shaped pipe section 500, which may be suitable for use in the aforementioned embodiments of the bath temperature maintenance heater, is shown in FIGS. 20 and 21. FIG. 20 is a lateral partial cross-section view of the T-shaped pipe section 500. The T-shaped pipe section 500 includes a center pipe segment 516 and a selectively removable transverse pipe branch 520. The center pipe segment 516 is tube-like and is formed from a suitable metallic material, such as stainless steel. The center pipe segment 516 includes a "T" junction 526, wherein a transverse aperture 530 is positioned along a portion of its length. The center pipe section 516 further includes a plurality of rectangular shaped bores 536 positioned around the transverse aperture 530. However, it will be appreciated that other embodiments may utilize round bores. The rectangular shaped bores 536 are sized for receiving fasteners 540 that selectively couple the pipe branch 520 to the center pipe segment 516.

Referring now to FIGS. 20 and 21, the transverse pipe branch 520 extends perpendicular to the length of the center pipe segment 516 and is connected in fluid flow communication with the transverse aperture 530 when assembled. The transverse pipe branch 520 has a hollow body 560, preferably made of plastic that includes a stepped-up portion 562 formed about its peripheral circumference and a circumferentially oriented end flange 564. The outside diameter of the end flange 564 is greater than the outside diameter of the stepped-up portion 562, as can be seen in FIGS. 20 and 21. The pipe branch 520 also includes two opposed inner shoulder portions 570 (only one being shown in FIG. 20) that extend partially around the center pipe segment end of the pipe branch inner cavity. The inner shoulder portion 570 includes bores 572 for receiving the fasteners 540 therethrough. The center pipe segment end of the pipe branch 520 further includes a peripheral extending slot 580 for which a sealing element 582, such as a rubber seal, seats therein. When assembled, the sealing element 582 is captured between the pipe branch 520 and the outer surface of the center pipe segment 516 to provide a leak-proof connection.

The transverse pipe branch 520 is selectively coupled to the center pipe segment 516 by fasteners 540. The fasteners 540 include a bolt 586 and a corresponding nut 588. The bolt 586 includes a flat head 590, a rectangular neck portion 592, and a threaded end 594. If round bores are used, it will be appreciated that neck portions 592 would be of corresponding shape. The bolts 586 are inserted from within the interior of the center pipe section 516 so that the flat head 590 rests against the inner surface of the center pipe segment 516. When routed through the bores 536, the rectangular neck portions 592 are received by and keyed to the bores 536. Thus, the keyed feature of the bores 536 prevents the screw 586 from rotating when loosening/tightening the nut 588. A washer 596 may be provided between the nut 588 and the shoulder portions 570 as known in the art, if desired.

The "T" junction of this embodiment allows the center pipe segment 516 to be selectively coupled in fluid flow communication with a device, such as a section of a hydromassage bath jet pump. The pipe branch 520 may be selectively coupled to the device by a transverse fastening assembly. In the embodiment illustrated in FIG. 20, the fastening assembly includes a unitary union nut 600. The union nut 600 includes an internal threaded portion 602 at one end, and a circumferential extending inner lip 606 at the other end. The inner lip 606 defines an opening sized to receive the stepped-portion 562 of the pipe branch 520 in a seated manner, the opening smaller than the union nut's opposite opening 610. When the union nut 600 is placed over the pipe branch 520 and the pipe branch 520 is secured to the central pipe segment 516, the union nut 600 is slidably retained at the end of the pipe branch 520 by the end flange 564. Thus, when the union nut 600 is in the position shown in FIG. 20, the stepped-up portion 562 of the pipe branch 520 is seated within the lip opening of the union nut 600, while the bottom surface of the inner lip 606 abuts against the end flange 564. The transverse pipe branch 520 may be selectively coupled to the device by rotation of the union nut 600. As the union nut 600 is rotated, the internal threads 602 of the union nut 600 removably engage the external threads of the threaded fitting of the device. The union nut 600 is rotated further until a fluid tight seal is provided between the device and the transverse pipe branch 520.

The T-shaped pipe section 500 constructed in accordance with the present invention provides a number of benefits over the prior art, of which a few will now be described. In the T-shaped pipe section 500 of the present invention, the pipe branch 520 is selectively coupled to the center pipe segment 516, unlike conventional T-shaped pipe sections used for bath temperature maintenance heaters that weld a metallic pipe branch to the metallic center pipe segment. This provides the following benefits. First, unlike conventional T-shaped pipe sections where the unitary union nut is permanently slidably secured between the center pipe segment and the end flange of the pipe branch when the pipe branch is welded to the center pipe segment, the unitary union nut associated with the present invention can be interchanged depending on the type of system in which the heater assembly is being installed. For example, if the device has non-standard external threads, a union nut having complimentary internal threads of the device can be exchanged for the standard threaded union nut simply by removing the pipe branch from the center pipe segment. Also, if the device has a different outer diameter, a union nut having a threaded end with the complimentary diameter of the device can easily be used. This would not be possible with the conventional T-shaped pipe sections where the pipe branch is welded or fixedly secured to the center pipe segment.

Additionally, the pipe branch 520 may be interchanged depending on the type of system in which the heater assembly is being installed. For example, if the device is fixed a distance away from the other pipe sections such that the length of the conventional pipe branch is insufficient to be coupled to the device, the insufficient length pipe branch can be interchanged with a pipe branch having the necessary length to be coupled to the device. Thus, the selective coupling feature of the T-shaped pipe section 500 provides the heater installer with the flexibility needed at the job site to reduce or eliminate the need to carry or purchase all of the variations of T-shaped pipe sections that may be needed at any given installation site. Finally, since the pipe branch 520 is selectively coupled to the center pipe segment through methods such as fasteners, instead of being fixedly coupled by welding, the pipe branch 520 does not need to be made out of the same material as the center pipe segment 516. Accordingly, the pipe branch 520 may preferably be made out of a suitable plastic material, such as PVC, to eliminate the possibility of corrosion of the pipe branch 520 due to, for example, welding, and the need for polishing.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A temperature maintenance heater assembly for maintaining the temperature of a previously heated fluid circulating through piping of a bath, comprising:

a heating element having first and second electrical contacts, and a predetermined maximum power rating, wherein the predetermined maximum power rating of the heating element is selected such that the temperature maintenance heater assembly maintains the fluid immediately upstream of the heating element within a specified safe temperature range with the heating element operating continuously at its maximum power rating;

a flow switch having an open state and a closed state, the flow switch being electrically connectable to a power supply and at least one electrical contact of the heating element for supplying electricity therebetween, wherein the flow switch acts to interrupt the supply of electricity to the heating element when a threshold value of fluid flow through the piping is not met, the control assembly continuing the supply of electricity to the heating element whenever the threshold value of fluid flow is met; and absence of a control device that controls the electricity supplied to the heating element based on the temperature of the heated fluid.

2. The temperature maintenance heater assembly of claim 1, wherein the predetermined maximum power rating of the heating element is no larger than approximately 700 watts.

3. The temperature maintenance heater assembly of claim 1, wherein the control device is a thermostat or a high limit switch.

4. The temperature maintenance heater assembly of claim 1, wherein the flow switch includes a switch actuator movable in at least the direction of fluid flow and operable to change the state of the flow switch.

5. The temperature maintenance heater assembly of claim 4, wherein the switch actuator is movable by the fluid flowing through the piping, thereby actuating a change in the state of the switch.

6. The temperature maintenance heater assembly of claim 4, wherein the switch actuator is pivotally coupled to the heater assembly, a portion of which extends partially into the piping, the switch actuator having an at-rest position, wherein the switch is in the open state, and movable to at least one position, wherein the switch is in the closed state.

7. The temperature maintenance heater assembly of claim 6, wherein the at least one position is two separate, spaced apart positions, whereby the switch is in the closed state.

8. The temperature maintenance heater assembly of claim 6, further comprising a diaphragm that surrounds a portion of the switch actuator, the switch actuator being pivotally coupled to the heater assembly by the diaphragm.

9. The temperature maintenance heater assembly of claim 8, wherein the diaphragm biases the switch actuator to the at-rest position.

10. The temperature maintenance heater assembly of claim 9, wherein the configuration of the diagram determines the threshold value.

11. The temperature maintenance heater assembly of claim 4, wherein the switch actuator includes a first contact member at one end having a cam surface, and wherein the flow switch includes a lever having a second contact member mounted at its end, the second contact member being in contact with the cam surface.

12. The temperature maintenance heater assembly of claim 11, wherein the first contact member is a cam, and the second contact member is a cam follower.

13. The temperature maintenance heater assembly of claim 4, wherein one end of the switch actuator has a planar fluid contact surface.

14. The temperature maintenance heater assembly of claim 4, wherein one end of the switch actuator has a curved fluid contact surface.

15. The temperature maintenance heater assembly of claim 1, wherein the flow switch acts to interrupt the supply of electricity to the heating element when a threshold value of fluid flow through the piping is not met regardless of the direction of fluid flow through the piping.

16. The temperature maintenance heater assembly of claim 1, wherein the heater assembly further comprises a mounting structure for mounting the flow switch to the piping, the mounting structure having an upper surface and a lower surface, and a first aperture passing from the upper surface to the lower surface.

17. The temperature maintenance heater assembly of claim 16, further comprising a heater assembly cover removably attached to the heater assembly, wherein the cover encloses the control assembly and a portion of the piping.

18. The temperature maintenance heater assembly of claim 17, wherein the heater assembly cover includes two cover section halves matable to define a cavity sized and configured to enclose the control assembly and a portion of the piping.

19. The temperature maintenance heater assembly of claim 18, wherein the cover is slidably coupled to the portion of the piping.

20. The temperature maintenance heater assembly of claim 18, wherein the cover is adapted to threadably connect to the remaining piping of the bath.

21. The temperature maintenance heater assembly of claim 1, wherein the flow switch is normally open.

22. A heater assembly for heating fluid circulating through piping of a bath, comprising:

a pipe section having an outer wall, an inlet, and at least one outlet, wherein the fluid is circulated through the pipe section between the inlet and the outlet;

a mounting structure attached to the outer wall of the pipe section, the mounting structure having an upper surface and a lower surface;

a flow switch mounted to the mounting structure, the flow switch including a pivoting actuator, a portion of which partially extends into the interior of the pipe section; and a heating element having a first and second electrical contact and a maximum power rating, the heating element being partially housed within the pipe section between the inlet and the outlet, at least one of the electrical contacts being conductively connected to the flow switch;

wherein the flow switch is operable to interrupt the supply of electricity to the heating element when a threshold limit of fluid flow through the pipe section is not met, and continuing the supply of electricity to the heating element whenever the threshold limit of fluid flow is met; and wherein the maximum power rating of the heating element is selected such that the heater assembly maintains the fluid immediately downstream of the heating element within a specified safe temperature range with the heating element operating continuously at its maximum power rating.

23. The heater assembly of claim 22, wherein the pipe section has a T-shaped profile including a center pipe segment and a transverse extending pipe branch in fluid communication with the center pipe segment.

24. The heater assembly of claim 23, wherein the pipe branch is selectively coupled to the center pipe segment.

25. The heater assembly of claim 24, wherein the pipe branch is constructed of a plastic material.

26. The heater assembly of claim 24, wherein the longitudinal axis of the actuator is substantially parallel to the longitudinal axis of the pipe branch.

27. A temperature maintenance heater assembly of a bath having a fluid capacity, the temperature maintenance heater assembly operable for maintaining the temperature of a heated fluid circulating through piping of the bath, the temperature maintenance heater assembly comprising:

a pipe section with an outer wall, an inlet, and at least one outlet;

a heating element being housed partially in the pipe section, the heating element having a first and second electrical contacts and a maximum power rating, wherein the maximum power rating of the heating element is selected based on the fluid capacity of the bath; and a control assembly coupled to the pipe section, the control assembly including a flow switch, the flow switch including first and second electrical terminals and a switch actuator pivotally movable from an at-rest position, wherein the flow switch is in an open position, to at least one different position remote from the at-rest position, wherein the flow switch is in a closed position, the control assembly being conductively connected to at least one of the electrical contacts of the heating element:

wherein the maximum power rating of the heating element is further selected such that the heater assembly maintains the fluid in the bath within a specified safe temperature range with the heating element operating continuously at its maximum power rating.

28. The temperature maintenance heater assembly of claim 27, wherein the switch actuator is pivotally movable from an at-rest position, wherein the flow switch is in an open position, to at least two different positions remote from the at-rest position, wherein the flow switch is in a closed position, the switch actuator movable in at least the direction of fluid flow.

29. The temperature maintenance heater assembly of claim 27, wherein the pipe section has a T-shaped profile including a center pipe segment and a transverse extending pipe branch in fluid communication with the center pipe segment.

30. The temperature maintenance heater assembly of claim 29, wherein the pipe branch is selectively coupled to the center pipe segment.

31. The temperature maintenance heater assembly of claim 30, wherein the pipe branch is constructed of a plastic material.

32. The temperature maintenance heater assembly of claim 30, wherein the pipe branch includes a circumferentially extending stepped-up portion disposed adjacent to an end flange.

33. The heater assembly of claim 30, wherein the pipe branch is selectively coupled to the center pipe segment by at least one threaded fastener having an externally threaded end, the externally threaded end extending away from the center pipe segment.

34. A pipe section for a heater assembly of a bath comprising:

a center pipe segment sized and configured to accept a heating element therein; and a pipe branch selectively coupled to the center pipe segment, the pipe branch extending transverse from the center pipe segment and fluidly communicating with the center pipe segment when coupled thereto, the pipe branch including an end flange.

35. The pipe section of claim 34, wherein the pipe branch is selectively coupled to the center pipe segment by threaded fasteners having externally threaded ends the externally threaded ends extending away from the center pipe segment.

36. The pipe section of claim 34, wherein the pipe branch is constructed of a material different than the center pipe segment.

37. A method of maintaining the temperature of a heated fluid circulating through a bath having associated piping, comprising:

circulating the heated fluid through a pipe segment of the associated piping by a pump, the pipe segment including an inlet, at least one outlet, and a heating element housed partially within the pipe section, wherein the pump is adapted to be connected in fluid communication to at least one exit port of the bath;

transferring heat from the heat element to the heated fluid circulating through the pipe segment, the heating element receiving power from a power source and having a pre-determined maximum power rating, wherein the predetermined maximum power rating of the heating element is selected such that the fluid in the bath is maintained within a specified safe temperature range with the heating element operating continuously at its maximum power rating; and supplying power continuously to the heating element so that the heating element operates at its maximum power rating absent abnormal operating conditions.

38. The method of claim 37, further comprising:

terminating the power supplied to the heating element when an abnormal operating condition is determined.

39. The method of claim 38, wherein the abnormal condition is determined based on the flow rate of the heated fluid flowing through the pipe segment.

40. The method of claim 39, wherein the abnormal condition is determined if the flow rate of the heated fluid flowing through is below a threshold limit.

* * * * *

UNITED STATES PATENT AND TRADEMARK OFFICE

CERTIFICATE OF CORRECTION

PATENT NO. : 6,643,454 B1
DATED : November 4, 2003
INVENTOR(S) : G.P. Rochelle

It is certified that error appears in the above-identified patent and that said Letters Patent is hereby corrected as shown below:

Column 22,
Line 13, “met regardless” should read -- met, regardless --

Column 23,
Line 21, “having a first” should read -- having first --
Line 35, “element:” should read -- element; --

Column 24,
Line 22, “ends the” should read -- ends, the --
Line 36, “heat element” should read -- heating element --
Line 39, “pre-determined” should read -- predetermined --

Signed and Sealed this

Twenty-fourth Day of February, 2004

JON W. DUDAS
*Acting Director of the United States Patent and Trademark Office*